US011952691B2

(12) United States Patent
Tokura

(10) Patent No.: US 11,952,691 B2
(45) Date of Patent: Apr. 9, 2024

(54) APPLIQUE DATA MANAGEMENT APPARATUS, SEWING MACHINE, AND STORAGE MEDIUM STORING APPLIQUE DATA MANAGEMENT PROGRAM

(71) Applicant: BROTHER KOGYO KABUSHIKI KAISHA, Nagoya (JP)

(72) Inventor: Masashi Tokura, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 113 days.

(21) Appl. No.: 17/807,969

(22) Filed: Jun. 21, 2022

(65) Prior Publication Data

US 2023/0034819 A1 Feb. 2, 2023

(30) Foreign Application Priority Data

Jul. 30, 2021 (JP) ..... 2021-125176

(51) Int. Cl.
*D05B 19/08* (2006.01)
*D05B 19/10* (2006.01)
*D05C 5/06* (2006.01)

(52) U.S. Cl.
CPC ..... *D05B 19/08* (2013.01); *D05B 19/10* (2013.01); *D05C 5/06* (2013.01)

(58) Field of Classification Search
CPC ..... D05B 19/08; D05B 19/10; D05C 5/00; D05C 5/02; D05C 5/06
See application file for complete search history.

(56) References Cited

U.S. PATENT DOCUMENTS 5,438,520 A * 8/1995 Satoh ..... D05B 19/08 112/102.5
2013/0239858 A1 9/2013 Ihira et al.
2014/0083345 A1* 3/2014 Tokura ..... D05B 19/08 112/470.01
2015/0240399 A1* 8/2015 Ihira ..... D05C 7/00 112/102.5
2016/0031108 A1* 2/2016 Bailie ..... B26D 5/005 700/134

FOREIGN PATENT DOCUMENTS

JP H06-306759 A 11/1994
JP H08-276084 A 10/1996
JP 2005-000678 A 1/2005
JP 2013-188363 A 9/2013

* cited by examiner

*Primary Examiner* — Nathan E Durham
(74) *Attorney, Agent, or Firm* — Oliff PLC

(57) ABSTRACT

A controller acquires sewing data for sewing an applique piece on a sewing target material, the applique piece having a shape having a hole, the hole being a closed area surrounded by at least part of the applique piece, identifies a contour of the applique piece while distinguishing an inner contour and an outer contour, the inner contour being the contour defining the hole of the applique piece, the outer contour being the contour other than the inner contour, determines, based on the acquired sewing data, whether an inner stitch and an outer stitch are arranged at positions closer to each other than a particular distance or at positions overlapping each other, and outputs an error notification in response to determining that the inner stitch and the outer stitch are arranged at positions closer to each other than the particular distance or at positions overlapping each other.

11 Claims, 17 Drawing Sheets

EMBROIDERY PATTERN DATA

| SEWING ORDER | 1 | 2 | 3 | 4 | 5 | 6 |
|---|---|---|---|---|---|---|
| DATA TYPE | PROCESSING DATA | ALIGNMENT DATA | SEWING DATA | PARTIAL PATTERN 60 DATA | PARTIAL PATTERN 61 DATA | PARTIAL PATTERN 62 DATA |
| PROHIBITION FLAG | 0 | 0 | 0 | 1 | 0 | 0 |

APPLIQUE DATA MANAGEMENT APPARATUS, SEWING MACHINE, AND STORAGE MEDIUM STORING APPLIQUE DATA MANAGEMENT PROGRAM

REFERENCE TO RELATED APPLICATIONS

This application claims priority from Japanese Patent Application No. 2021-125176 filed on Jul. 30, 2021. The entire content of the priority application is incorporated herein by reference.

BACKGROUND ART

Conventionally, sewing has been performed in which an applique piece having a hole is sewn onto a sewing target material.

DESCRIPTION

For example, an applique embroidery data creation method includes generating embroidery data for sewing an applique piece of a letter "A" having a hole. Based on the embroidery data, satin stitch is applied to the inner contour and the outer contour, and the patch with a hole is sewn.

As described above, in order to sew an applique piece having a hole on a sewing target material, it is common to sew satin stitch and so on on the inner contour and the outer contour. However, when a user wants to sew an applique piece with a hole in which the distance between the inner contour and the outer contour is short, when the user wants to increase the stitch width of the satin stitch for sewing, and so on, the stitch of the inner contour and the stitch of the outer contour may be formed very closely or may overlap each other. If the stitch of the inner contour and the stitch of the outer contour are formed very closely or formed to overlap each other, the periphery of the hole in the applique piece is hidden by the stitch for sewing the applique piece, which deteriorates the appearance.

In view of the foregoing, an example of an object of this disclosure is to provide an applique data management apparatus, a sewing machine, and a storage medium storing an applique data management program that manage sewing data for sewing an applique piece having a hole and, when the stitch of the inner contour and the stitch of the outer contour sewn based on the sewing data are closer than a particular distance or overlap each other, output notification of an error of the sewing data.

According to one aspect, this specification discloses an applique data management apparatus. The applique data management apparatus includes an output interface and a controller. The controller is configured to: acquire sewing data for sewing an applique piece on a sewing target material, the applique piece having a shape having a hole, the hole being a closed area surrounded by at least part of the applique piece; identify a contour of the applique piece while distinguishing an inner contour and an outer contour, the inner contour being the contour defining the hole of the applique piece, the outer contour being the contour other than the inner contour; determine, based on the acquired sewing data, whether an inner stitch and an outer stitch are arranged at positions closer to each other than a particular distance or at positions overlapping each other, the inner stitch being formed along the inner contour, the outer stitch being formed along the outer contour; and output an error notification through the output interface in response to determining that the inner stitch and the outer stitch are arranged at positions closer to each other than the particular distance or at positions overlapping each other.

According to another aspect, this specification also discloses a sewing machine. The sewing machine includes an output interface and a controller. The controller is configured to: acquire sewing data for sewing an applique piece on a sewing target material, the applique piece having a shape having a hole, the hole being a closed area surrounded by at least part of the applique piece; identify a contour of the applique piece while distinguishing an inner contour and an outer contour, the inner contour being the contour defining the hole of the applique piece, the outer contour being the contour other than the inner contour; determine, based on the acquired sewing data, whether an inner stitch and an outer stitch are arranged at positions closer to each other than a particular distance or at positions overlapping each other, the inner stitch being formed along the inner contour, the outer stitch being formed along the outer contour; and output an error notification through the output interface in response to determining that the inner stitch and the outer stitch are arranged at positions closer to each other than the particular distance or at positions overlapping each other.

According to still another aspect, this specification also discloses a non-transitory computer-readable storage medium storing an applique data management program including a set of program instructions for an applique data management apparatus.

The set of program instructions, when executed by a controller of the applique data management apparatus, causes the applique data management apparatus to perform: acquiring sewing data for sewing an applique piece on a sewing target material, the applique piece having a shape having a hole, the hole being a closed area surrounded by at least part of the applique piece; identifying a contour of the applique piece while distinguishing an inner contour and an outer contour, the inner contour being the contour defining the hole of the applique piece, the outer contour being the contour other than the inner contour; determining, based on the acquired sewing data, whether an inner stitch and an outer stitch are arranged at positions closer to each other than a particular distance or at positions overlapping each other, the inner stitch being formed along the inner contour, the outer stitch being formed along the outer contour; and outputting an error notification through an output interface of the applique data management apparatus in response to determining that the inner stitch and the outer stitch are arranged at positions closer to each other than the particular distance or at positions overlapping each other.

According to the applique data management apparatus, before sewing an applique piece having a hole on a sewing target material, the user is notified that the stitch of the inner contour and the stitch of the outer contour are arranged at positions closer than a particular distance or positions overlapping each other. This enables the user to easily correct the data or change the shape of the applique piece and prevents deterioration of the appearance of the stitch of sewing around the hole of the applique piece in advance.

FIG. 1 is a perspective view of a system 1 including a server 2, a sewing machine 3, and a cutting device 4.

Hereinafter, an embodiment of this disclosure will be described with reference to the drawings. These drawings are used for explaining the technical features of this disclosure, and the configuration and so on of the apparatus described are merely explanatory examples. Hereinafter, the directions used in the description are the same as those shown in FIG. 1.

<Basic Configuration of System 1>

Figure 1:
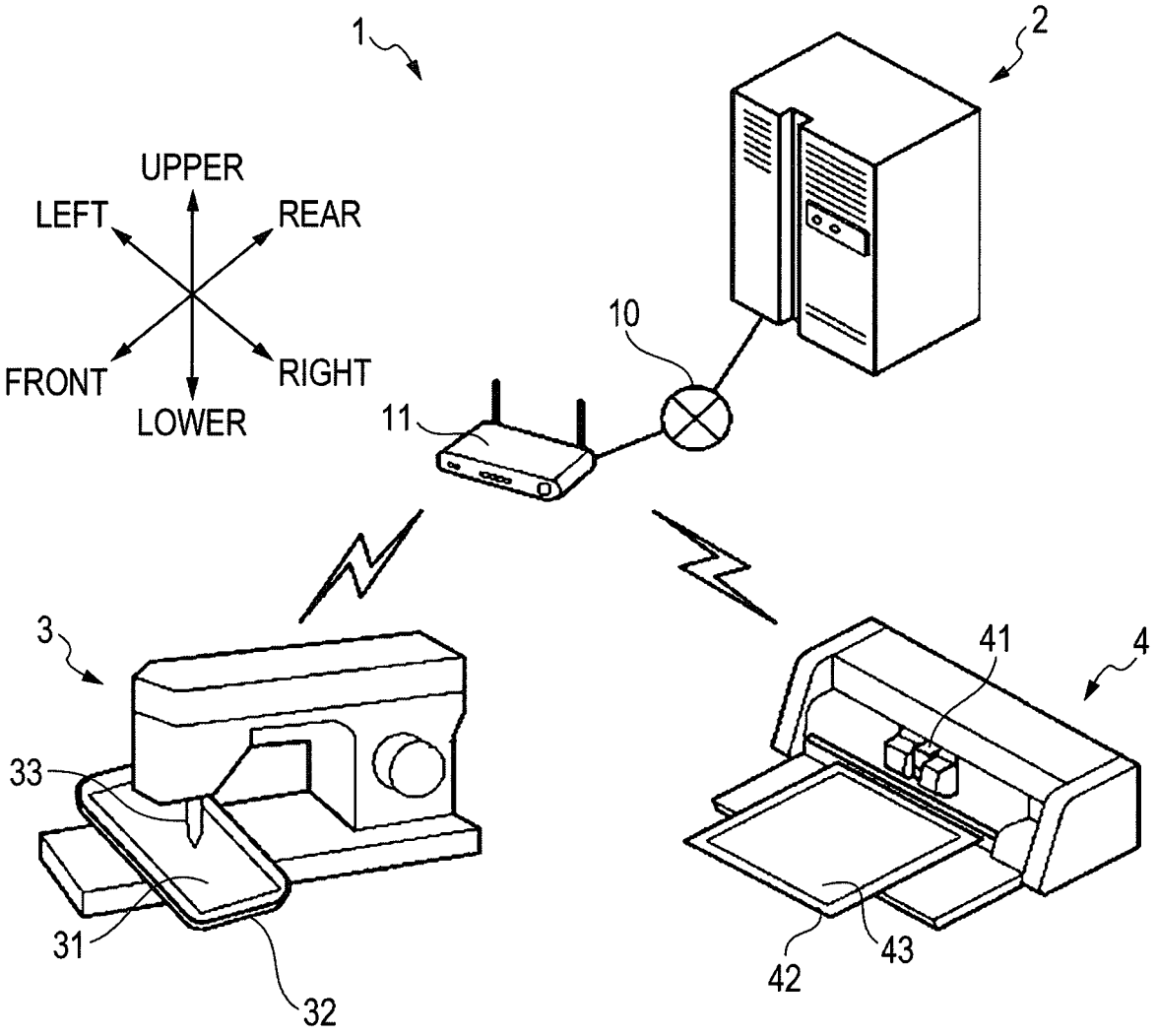

A system 1 will be described with reference to FIG. 1. The system 1 includes a server 2, a sewing machine 3, and a cutting device 4. The server 2 is wirelessly connected to an access point 11 via a network 10. The sewing machine 3 and the cutting device 4 are communicably connected to the access point 11. Thus, the server 2, the sewing machine 3, and the cutting device 4 communicate with each other via the network 10 and the access point 11. For example, since the user creates an applique piece 7 using the cutting device 4 and sews the applique piece 7 on a sewing target material 31 using the sewing machine 3, the sewing machine 3 and the cutting device 4 are installed in the same room.

Figure 5:
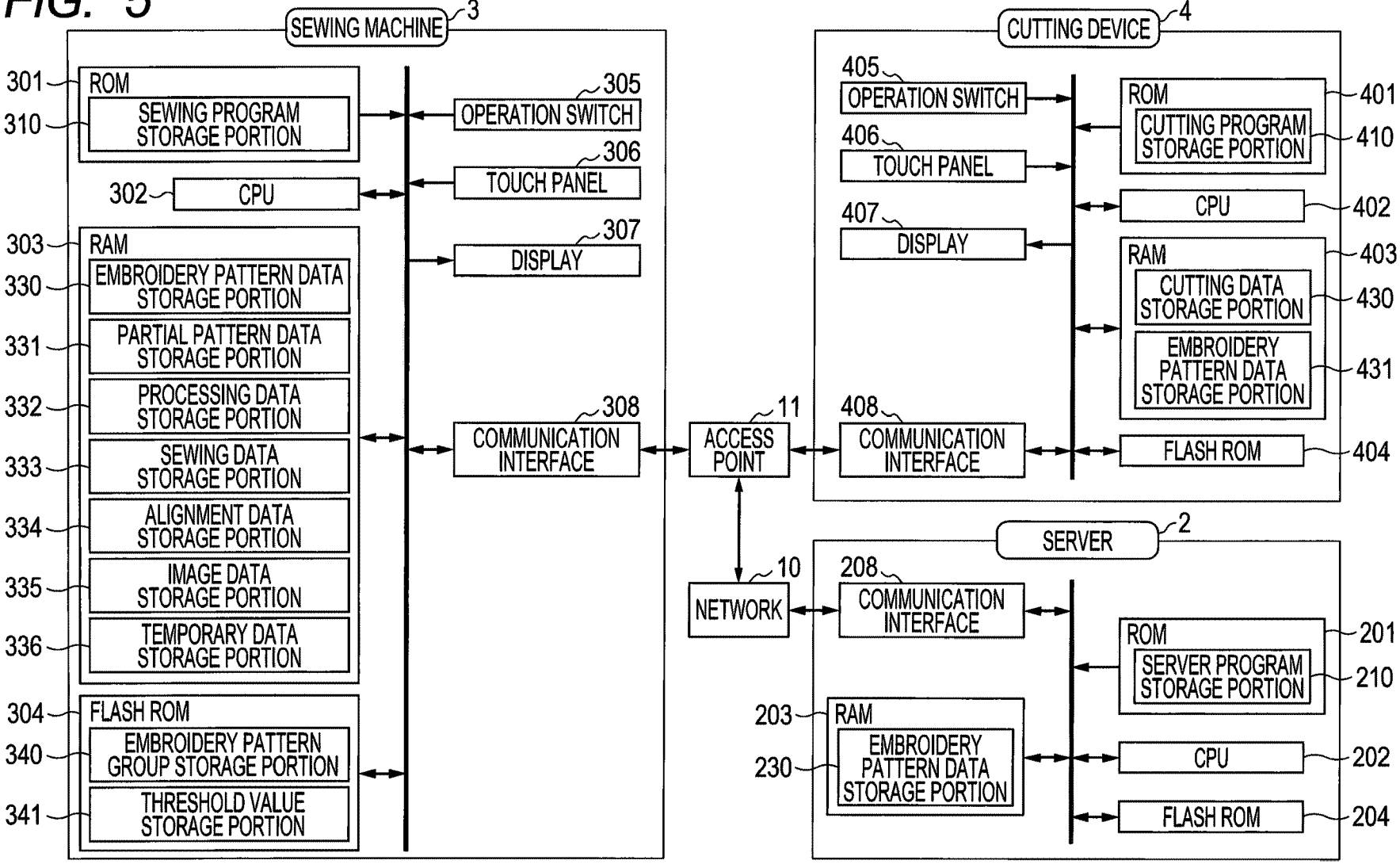
FIG. 5 is a block diagram showing an electrical configuration of the system 1.

The sewing machine 3 has a function of performing sewing on the sewing target material 31 held by an embroidery frame 32. As shown in FIG. 1, the sewing machine 3 mainly includes a needle bar 33, a sewing needle (not shown), a spindle drive unit (not shown), the embroidery frame 32, and an embroidery frame drive unit (not shown). The spindle drive unit moves the sewing needle attached to the needle bar 33 in the vertical direction. The embroidery frame drive unit moves the embroidery frame 32 back and forth and left and right. The sewing machine 3 performs arbitrary sewing by moving the sewing needle up and down while moving the embroidery frame 32 on which the sewing target material 31 is held. Although not shown in FIG. 1, the sewing machine 3 includes an operation switch 305, a touch panel 306, and a display 307 (FIG. 5).

The cutting device 4 has a function of cutting a cutting target material 43 by a cutting blade (not shown) of a cartridge 41. As shown in FIG. 1, the cutting device 4 mainly includes the cartridge 41, a holding plate 42, a conveyance mechanism (not shown), a first movement mechanism (not shown), and a second movement mechanism (not shown). The conveyance mechanism moves the holding plate 42 in the front-rear direction. The first movement mechanism moves the cartridge 41 in the left-right direction. The second movement mechanism moves the cartridge 41 in the vertical direction. The cutting device 4 moves the cartridge 41 downward to bring the cutting blade into contact with the cutting target material 43. In this contact state, the cutting device 4 moves the holding plate 42 holding the cutting target material 43 in the front-rear direction and moves the cartridge 41 in the left-right direction to cut the cutting target material 43 in an arbitrary shape.

<Shape 5 Having Hole>

Figure 2:
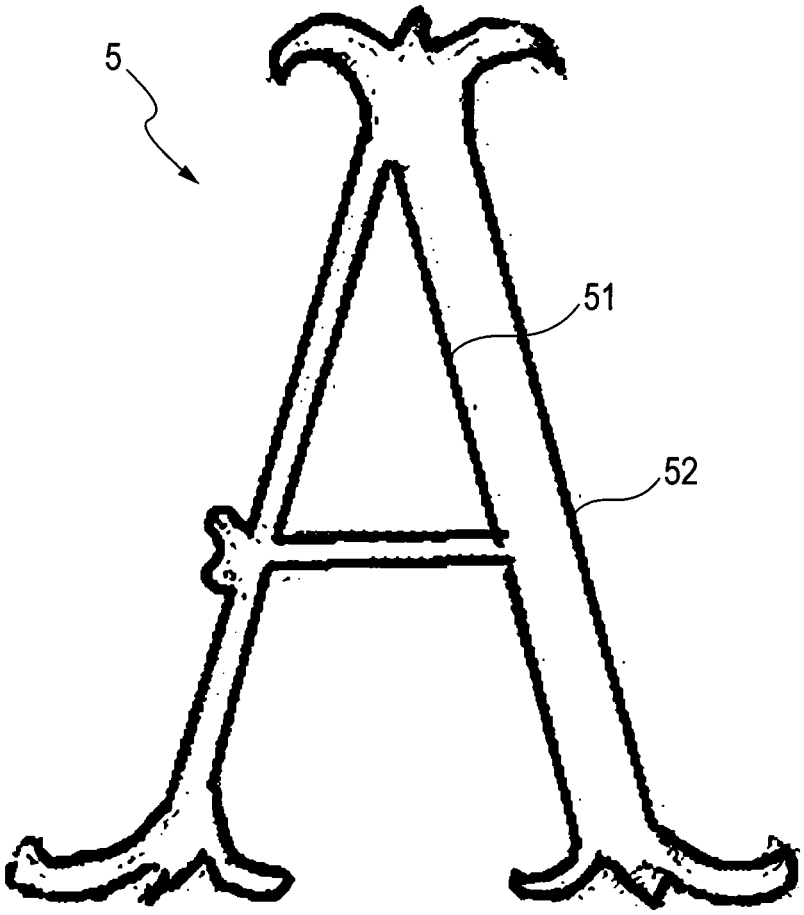
FIG. 2 is an explanatory diagram showing a shape 5 having a hole.

A shape 5 having a hole will be described with reference to FIG. 2. The shape 5 having a hole refers to a shape having a hole that is a closed area surrounded by at least a part of a component constituting the shape of a pattern or an applique piece, and is a shape such as "A" shown in FIG. 2, for example. In the present embodiment, the embroidery pattern 6 formed by sewing and the applique piece 7 have a shape such as the shape 5. In the shape 5, an inner contour 51 represents the shape of the contour defining the hole, and an outer contour 52 represents the shape of the contour other than the inner contour 51 among the contours defining the shape 5.

<Example of Display Screen of Sewing Machine 3>

Figure 3:
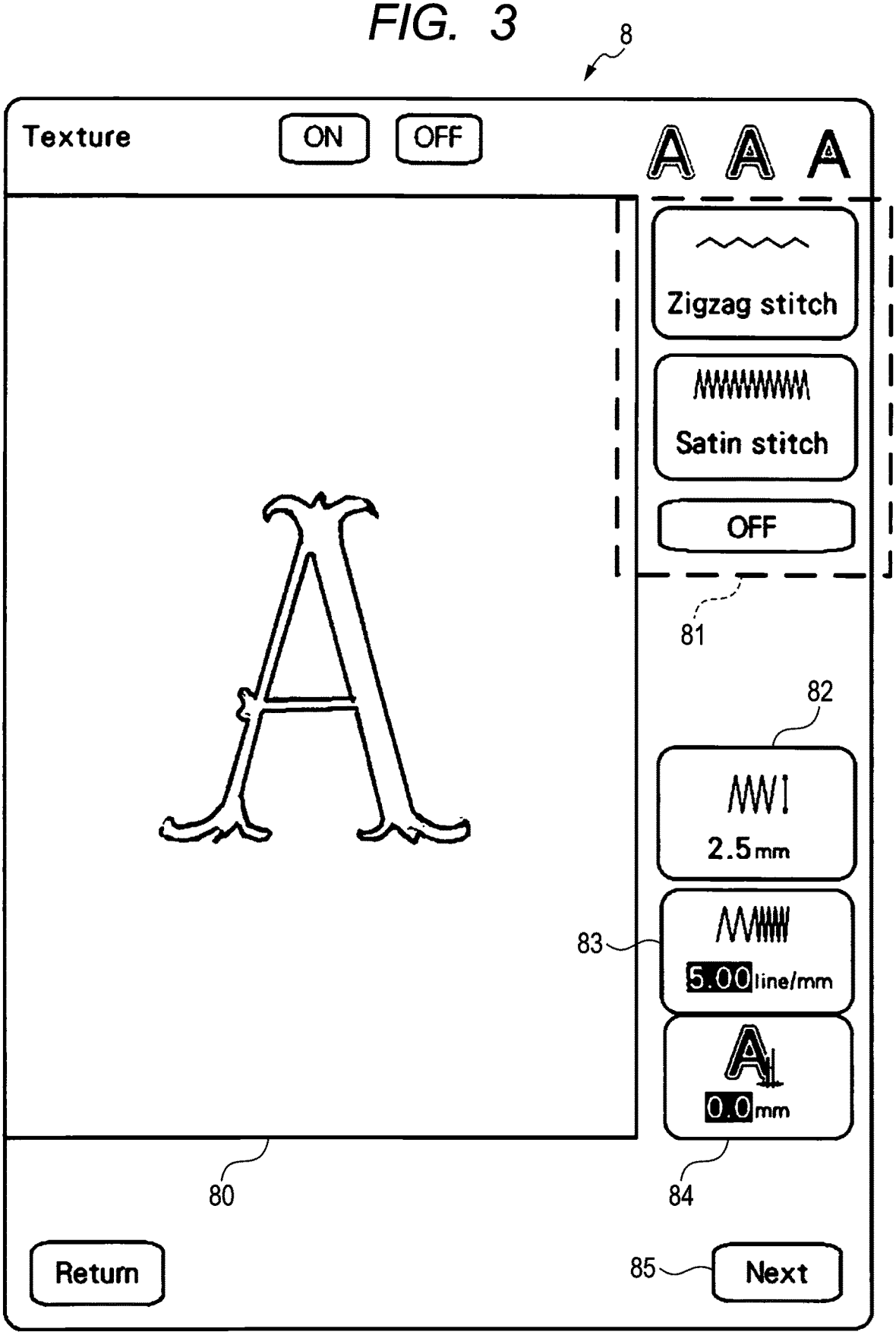
FIG. 3 is an explanatory diagram showing a change reception screen 8 which is one of display screens.
Figure 4:
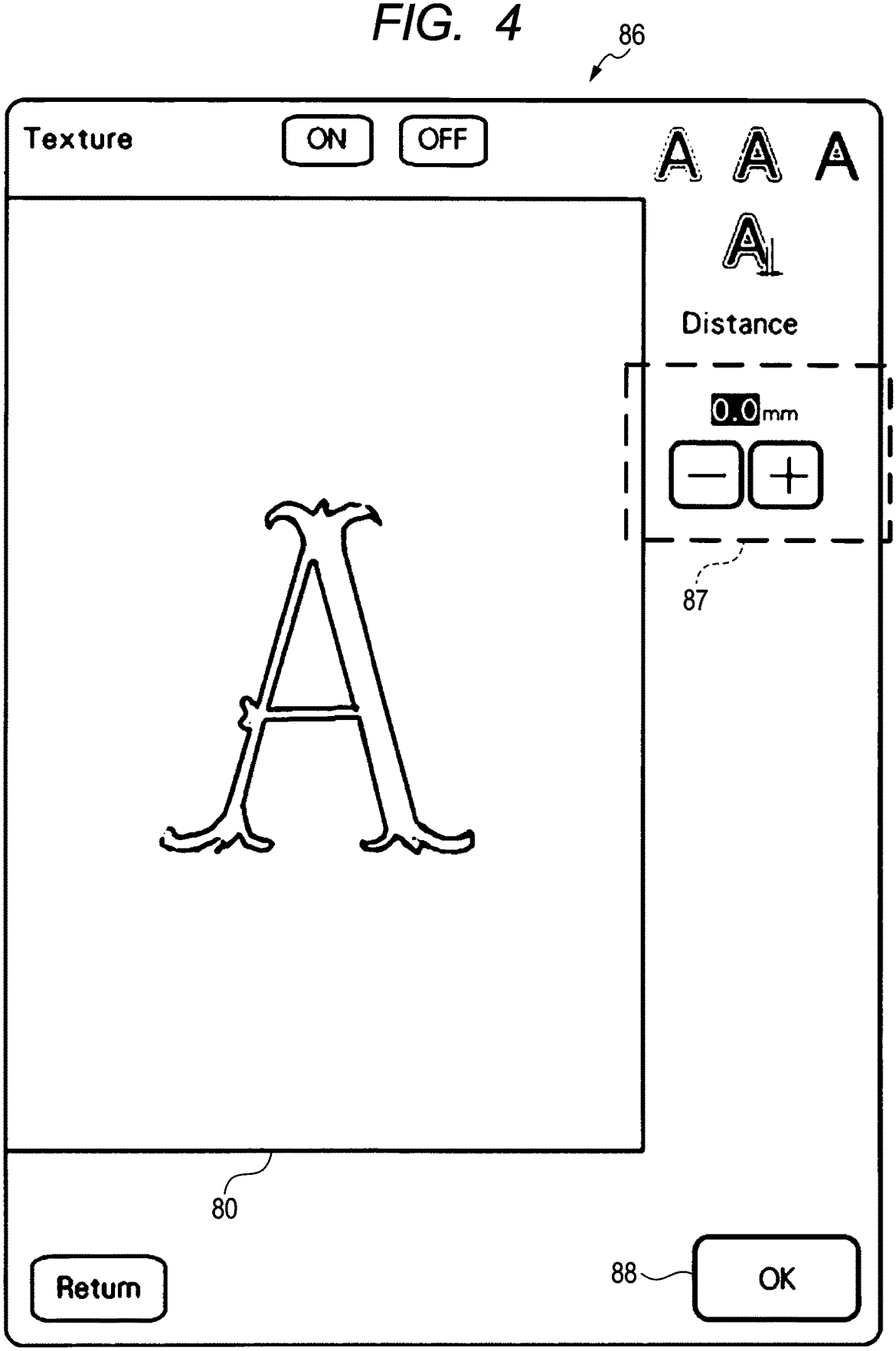
FIG. 4 is an explanatory diagram showing an offset change screen 86 which is one of the display screens.

An example of a display screen of the sewing machine 3 will be described with reference to FIGS. 3 and 4. The display screen is displayed on a display 307 of the sewing machine 3 and is operated by the touch panel 306 of the display 307. The display screen transitions to one of a plurality of states such as a state at the time of selecting the thread color, a state at the time of receiving a change of offset data, and a state at the time of displaying a preview image. For example, a change reception screen 8 shown in FIG. 3 is an example of a display screen in the state at the time of receiving a change of stitch width data, density data, and offset data. The change reception screen 8 mainly has an image display portion 80 for displaying an image, a stitch selection portion 81 for selecting a stitch type for sewing, a stitch width operation button 82 for changing a stitch width, a density operation button 83 for changing the density, an offset operation button 84 for changing an offset distance 70, and a Next button 85 for transitioning to the next display screen. Images such as an embroidery pattern image 6G and a partial pattern image 60G are displayed on the image display portion 80. The stitch selection portion 81 has a zigzag stitch button, a satin stitch button, and an OFF button, and the stitch type of sewing is changed to any of zigzag stitch, satin stitch, and non-stitch setting. When the user touches the offset operation button 84, the display screen transitions from the change reception screen 8 to an offset change screen 86. The display screen shown in FIG. 4 is the offset change screen 86. The offset change screen 86 has the image display portion 80, an offset change portion 87, and an OK button 88. The offset change portion 87 includes a plus (+) button, a minus (−) button, and a current offset display. The user changes the value set in the offset distance 70 by touching the plus (+) button or the minus (−) button of the offset change portion 87. The current offset display displays the value currently set for the offset distance 70. The OK button 88 is touched for storing the value shown in the current offset display as the offset distance 70 in a temporary data storage portion 336 and transitioning to the change reception screen 8. The process executed when the stitch width operation button 82 and the density operation button 83 are touched is similar to the process executed when the offset operation button 84 is touched, and the user changes the value set for the stitch width and the value set for the density. The Next button 85 is touched for storing the set stitch width data, density data, and offset data in a sewing data storage portion 333 and transitioning to the next display screen.

<Electrical Configuration of Sewing Machine 3>

The electrical configuration of the sewing machine 3 will be described with reference to FIG. 5. The sewing machine 3 includes a ROM 301, a CPU 302, a RAM 303, a flash ROM 304, and a communication interface 308 as a sewing machine controller. The ROM 303 stores a boot program, a BIOS, and so on, and includes a sewing program storage portion 310. The sewing program storage portion 310 stores a sewing program, which is a main program for the CPU 302 to control the sewing machine 3. The RAM 303 includes an embroidery pattern data storage portion 330, a partial pattern data storage portion 331, a processing data storage portion 332, a sewing data storage portion 333, an alignment data storage portion 334, an image data storage portion 335, and a temporary data storage portion 336. The flash ROM 304 includes an embroidery pattern group storage portion 340 and a threshold value storage portion 341. A plurality of embroidery pattern data is stored in the embroidery pattern group storage portion 340. The threshold value storage portion 341 stores a threshold value representing a particular distance. The threshold value is a distance indicating an allowable proximity between an inner stitch for sewing the inner contour of the applique piece 7 and an outer stitch for sewing the outer contour of the applique piece 7 when the applique piece 7 having a hole is sewn on the sewing target material 31, and represents the minimum distance between the inner stitch and the outer stitch. The contour of the applique piece 7 is sewn by setting needle drop positions on both sides of the contour and forming stitches on both sides of the contour so that sewing threads cross the contour. The communication interface 308 is an interface for connecting the sewing machine 3 to the access point 11.

In addition, the operation switch 305, the touch panel 306, and the display 307 are electrically connected to the sewing machine controller. The operation switch 305 also includes a power switch. The front surface of the display 307 is configured by the touch panel 306. The user operates the touch panel 306 with his/her finger or a stylus.

The electrical configuration of the server 2 will be described with reference to FIG. 5. The server 2 includes a ROM 201, a CPU 202, a RAM 203, a flash ROM 204, and a communication interface 208 as a server controller. The ROM 201 stores a boot program, a BIOS, and so on, and includes a server program storage portion 210. The server program storage portion 210 stores a server program, which is a main program for the CPU 202 to control the server 2. The RAM 203 includes an embroidery pattern data storage portion 230. The embroidery pattern data storage portion 230 stores embroidery pattern data received from the sewing machine 3 via the network 10 and the access point 11. The communication interface 208 is an interface for connecting the server 2 to the network 10.

The electrical configuration of the cutting device 4 will be described with reference to FIG. 5. The cutting device 4 includes a ROM 401, a CPU 402, a RAM 403, a flash ROM 404, and a communication interface 408 as a cutting device controller. The ROM 401 stores a boot program, a BIOS, and so on, and includes a cutting program storage portion 410. The cutting device program storage portion 410 stores a cutting program, which is a main program for the CPU 402 to control the cutting device 4. The RAM 403 includes a cutting data storage portion 430 and an embroidery pattern data storage portion 431. The cutting data storage portion 430 stores cutting data for the cutting device 4 to cut the cutting target material 43 in an arbitrary shape. The embroidery pattern data storage portion 431 stores embroidery pattern data received from the server 2 via the network 10 and the access point 11. The communication interface 408 is an interface for connecting the cutting device 4 to the access point 11.

In addition, an operation switch 405, a touch panel 406, and a display 407 are electrically connected to the cutting device controller. The operation switch 405 also includes a power switch. The front surface of the display 407 is configured by the touch panel 406. The user operates the touch panel 406 with his/her finger or a stylus.

<Embroidery Pattern 6, Partial Patterns 60-62>

Figure 6:
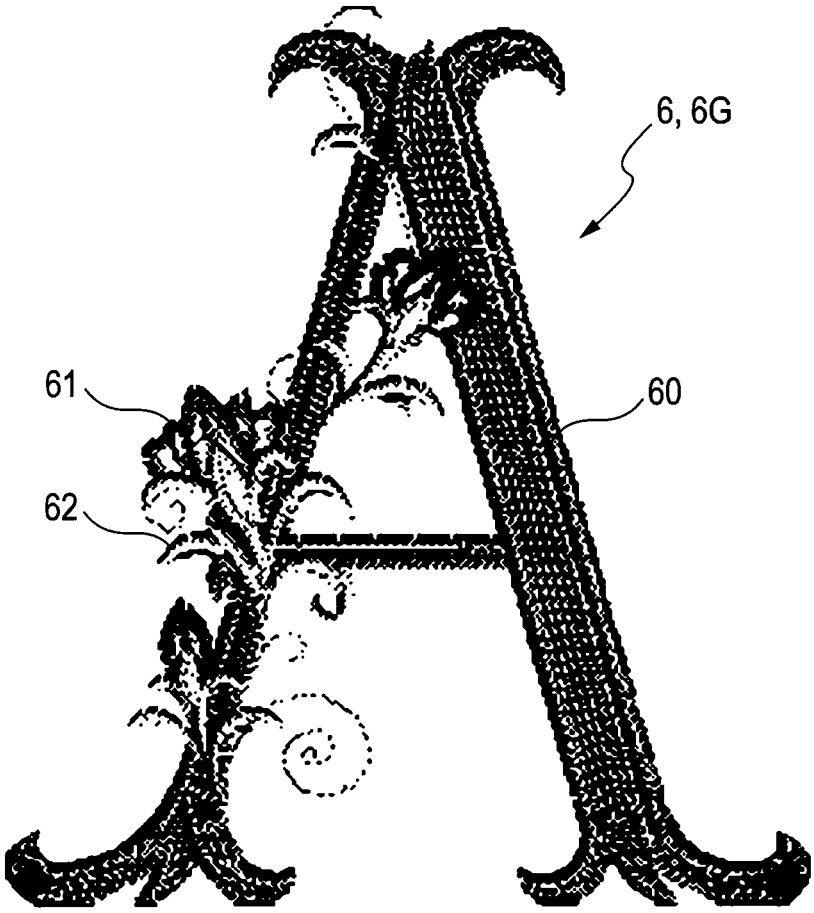
FIG. 6 is an explanatory diagram showing an embroidery pattern 6.
Figure 7:
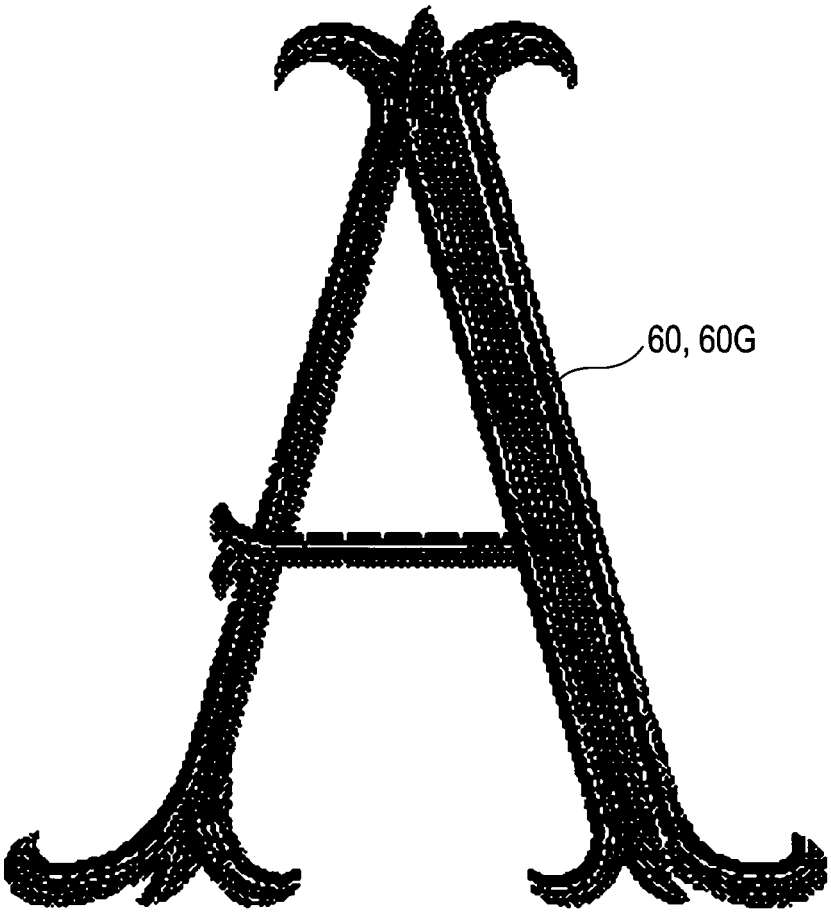
FIG. 7 is an explanatory diagram showing a partial pattern 60.

The embroidery pattern 6 and partial patterns 60 to 62 will be described with reference to FIGS. 6 and 7. The embroidery pattern 6 is a stitch pattern formed on the sewing target material 31 based on the embroidery pattern data. The embroidery pattern 6 shown in FIG. 6 is an overall pattern composed of a partial pattern 60 representing "A", a partial pattern 61 representing a flower, and a partial pattern 62 representing a leaf. FIG. 7 shows the partial pattern 60 when only the partial pattern 60 is extracted from the embroidery pattern 6. In the embroidery pattern 6, the partial patterns 60 to 62 are distinguished by the thread color. The embroidery pattern data includes needle drop coordinate data, a thread color attribute, contour attribute, a sewing order, and a prohibition flag. The needle drop coordinate data is data in which a needle drop position, which is the position of the stitch for forming the embroidery pattern 6, is represented by the coordinate position on the embroidery frame. The needle drop coordinate data has coordinate data of all needle drop positions necessary for forming the embroidery pattern 6. The thread color attribute is attribute data added to the needle drop coordinate data, and indicates the color of the stitch formed at the coordinate position represented by the needle drop coordinate data. For example, in the embroidery pattern 6 shown in FIG. 6, the color of the stitch of the partial pattern 60 is shown in yellow, and the color of the stitch of the partial pattern 62 is shown in green. Thus, the needle drop coordinate data for forming the partial pattern 60 is given the thread color attribute of "yellow", and the needle drop coordinate data for forming the partial pattern 62 is given the thread color attribute of "green". The contour attribute is attribute data given to the needle drop coordinate data, and is given only to specific needle drop coordinate data representing the coordinate position defining the contour of each of the partial patterns 60 to 62. Thus, the needle drop coordinate data, the thread color attribute and the contour attribute are combined into one set of data. The thread color attribute identifies the needle drop coordinate data forming the partial patterns 60 to 62. The contour attribute identifies needle drop coordinate data that defines the contour of each of the partial patterns 60 to 62. The sewing order is a numerical value indicating the sewing order set for each of the partial patterns 60 to 62. For example, in the case of the embroidery pattern 6 shown in FIG. 6, since the partial pattern 62 is arranged over the partial pattern 60, the sewing order is set to "1" for the partial pattern 60 and "3" for the partial pattern 62. The prohibition flag is data indicating whether sewing is performed, and is set to "0" when sewing is performed and "1" when sewing is not performed. The initial value of the prohibition flag is set to "0". The prohibition flag is set for each of the partial patterns 60 to 62.

<Applique Piece 7>

Figure 8:
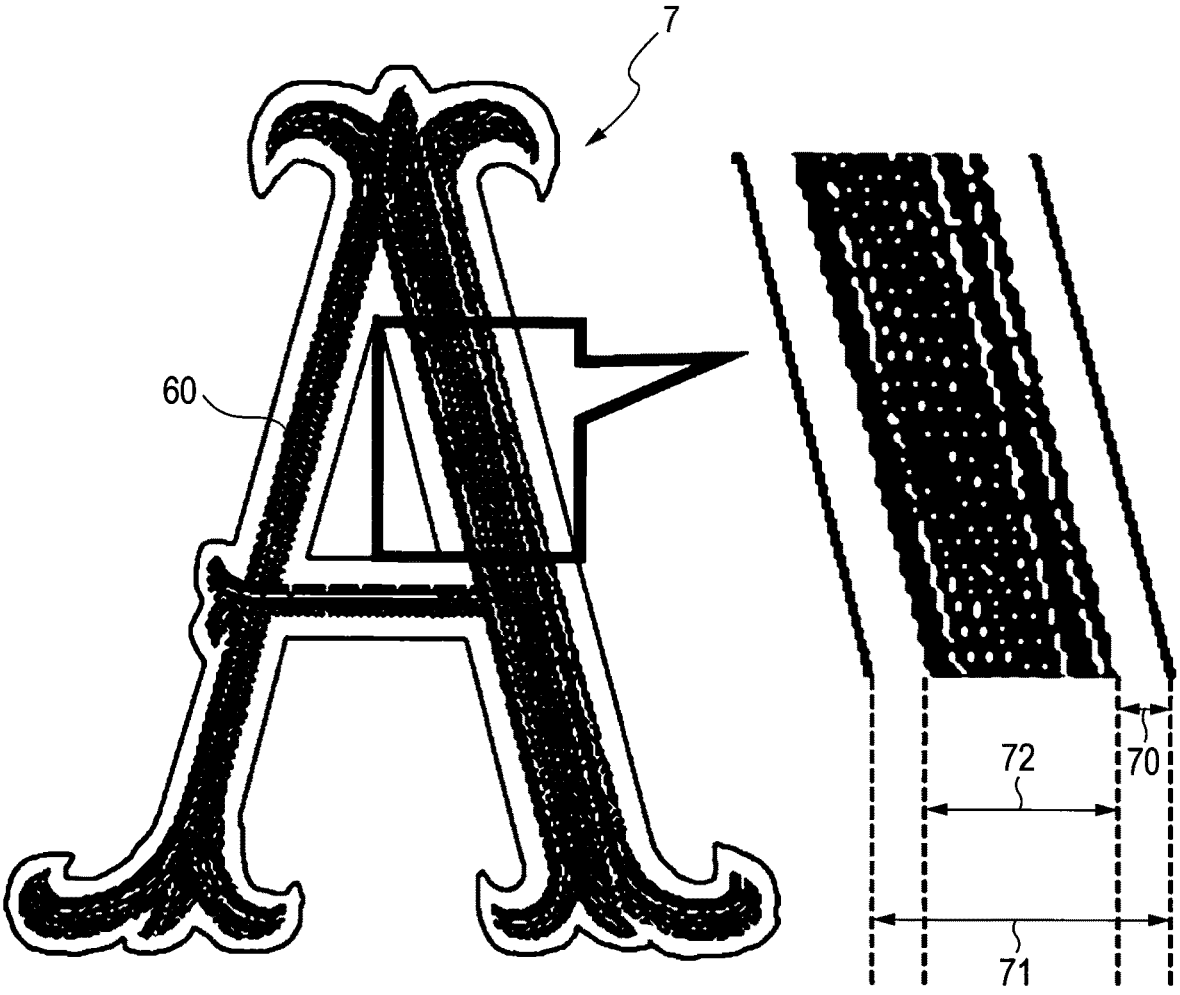
FIG. 8 is an explanatory diagram showing an applique piece 7 and an offset distance 70.

The applique piece 7 will be described with reference to FIG. 8. As shown in FIG. 8, the applique piece 7 is, for example, an applique piece having the same shape as the shape of the partial pattern 60. The offset distance 70 is a distance between the contour of the partial pattern 60 and the contour of the applique piece 7 in the left-right direction or the vertical direction of the applique piece 7 shown in FIG. 8. The offset distance 70 shown in FIG. 8 is a distance in the left-right direction in FIG. 8. When the offset distance 70 is "0", the contour of the partial pattern 60 and the contour of the applique piece 7 match. By increasing the offset distance 70 from "0" to a positive value, or decreasing the same from "0" to a negative value, a fabric width 71 in the direction crossing the contour of the applique piece 7 is made wider or narrower than a pattern width 72 in the direction crossing the contour of the partial pattern 60.

<Embroidery Control Process of Sewing Machine 3>

Figure 9:
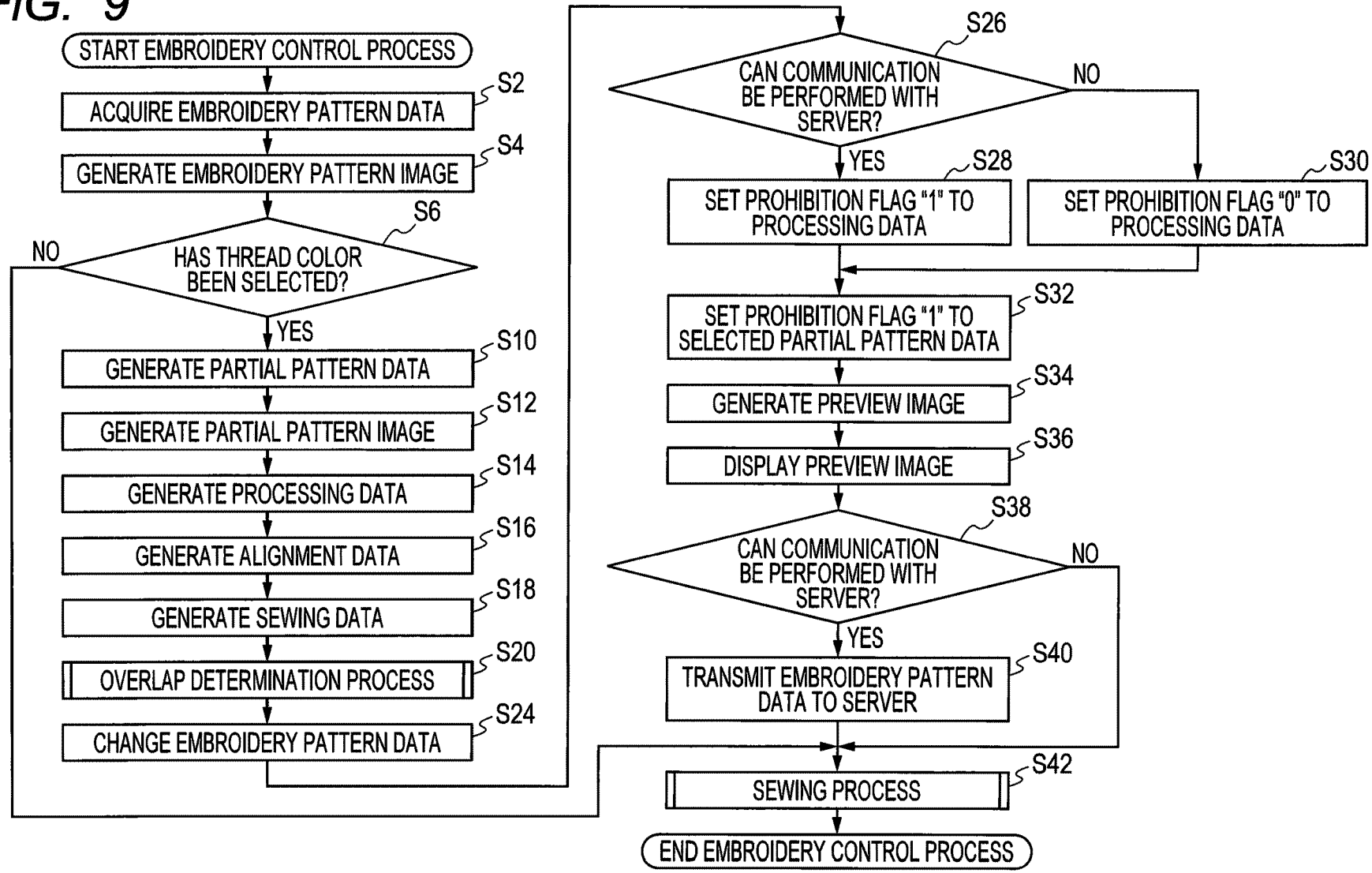
FIG. 9 is a flowchart of an embroidery control process executed by the sewing machine 3.

The operation of the embroidery control process executed by the sewing machine 3 will be described according to the flowchart shown in FIG. 9. When the user presses the power switch of the operation switch 305 of the sewing machine 3, the CPU 302 executes the sewing program stored in the sewing program storage portion 310 and starts the embroidery control process. Each of the series of processes indicated by S2 to S42 in FIG. 9 is a process executed by the CPU 302 of the sewing machine 3.

The user operates the touch panel 306 to select an image showing a desired embroidery pattern 6 from the embroidery pattern images displayed on the display 307. The CPU 302 reads and acquires embroidery pattern data for sewing the embroidery pattern 6 of the selected image from the embroidery pattern group storage portion 340 of the flash ROM 304 (S2). The embroidery pattern data includes the needle drop coordinate data, the thread color attribute, the contour attribute, the sewing order, and the prohibition flag. The CPU 302 stores the acquired embroidery pattern data in the embroidery pattern data storage portion 330 of the RAM 303.

The CPU 302 generates an embroidery pattern image 6G based on the embroidery pattern data acquired in S2 (S4). From the ratio of the size of the embroidery frame to the size of the generated embroidery pattern image 6G, the needle drop coordinate data is converted into the coordinate data on the embroidery pattern image 6G. The embroidery pattern image 6G is generated by drawing pixels in the color of the thread color attribute at the position represented by the coordinate data on the embroidery pattern image 6G. The generated embroidery pattern image 6G is displayed on the display 307. The user visually checks the selected embroidery pattern image 6G. The CPU 302 stores the embroidery pattern image 6G in the image data storage portion 335 of the RAM 303.

After the process of S4 is completed, an edit selection screen is displayed on the display 307. The edit selection screen has the image display portion 80, an Edit button, and an Embroidery button. The CPU 302 determines whether any thread color has been selected by the user (S6). When the user operates the touch panel 306 and touches the Edit button on the edit selection screen, the display screen transitions from the edit selection screen to the thread color selection screen. The thread color selection screen has the image display portion 80, a thread color selection portion, and a Next button. The user operates the touch panel 306 to select a desired thread color from the thread colors displayed in the thread color selection portion of the thread color selection screen. The desired thread color is the same thread color as the stitch forming the partial pattern 60 having the shape of the applique piece 7 desired by the user. The thread color displayed in the thread color selection portion of the thread color selection screen corresponds to the thread color attribute of the embroidery pattern data stored in the embroidery pattern data storage portion 330. When the user selects a thread color and touches the Next button, the CPU 302 acquires thread color information from the thread color attribute of the embroidery pattern data stored in the embroidery pattern data storage portion 330, and determines that the thread color is selected. When the user does not select the thread color and touches the Embroidery button on the edit selection screen, the CPU 302 does not acquire the thread color information, so that it is determined that the thread color is not selected. When the thread color has been selected (S6: YES), the CPU 302 advances the process to S10. When the thread color has not been selected (S6: NO), the CPU 302 advances the process to S42.

Based on the thread color information acquired in the process of S6, the CPU 302 acquires, from the embroidery pattern data, needle drop coordinate data to which the same thread color attribute as the selected thread color is given. For example, if the selected thread color is yellow, the CPU 302 acquires the needle drop coordinate data to which "yellow" is added as the thread color attribute. The CPU 302 generates partial pattern data based on the acquired needle drop coordinate data (S10). The partial pattern data includes the needle drop coordinate data, the thread color attribute, and the contour attribute. The thread color attribute and the contour attribute are attributes given to the needle drop coordinate data of the partial pattern data. The generated partial pattern data is stored in the partial pattern data storage portion 331 of the RAM 303.

The CPU 302 generates the partial pattern image 60G based on the partial pattern data stored in the partial pattern data storage portion 331 (S12). The partial pattern image 60G is generated from the needle drop coordinate data of the partial pattern data and the thread color attribute by the same processing as the embroidery pattern image 6G. For example, when yellow is selected as the thread color in S6, the partial pattern image 60G having the same shape as the partial pattern 60 shown in FIG. 7 is generated by a series of processes of S6 to S12. The generated partial pattern image 60G is displayed on the display 307. The display on the display 307 allows the user to visually check the partial pattern image 60G corresponding to the selected thread color. The CPU 302 stores the partial pattern image 60G in the image data storage portion 335 of the RAM 303.

The CPU 302 generates processing data based on the partial pattern data stored in the partial pattern data storage portion 331 (S14). The processing data includes needle drop coordinate data to which the contour attribute is given. The needle drop coordinate data of the processing data is generated by extracting the needle drop coordinate data to which the contour attribute is given from the needle drop coordinate data of the partial pattern data. The CPU 302 stores the generated processing data in the processing data storage portion 332 of the RAM 303. Processing data is generated for two different uses. As one use, the processing data is used as data for cutting the cutting target material 43 into the shape of the applique piece 7. When the user uses the cutting device 4, the cutting device 4 cuts the cutting target material 43 along the contour indicating the shape of the partial pattern 60 according to the processing data to create the applique piece 7. As another use, the processing data is used as data for sewing a cutting index indicating the shape of the applique piece 7 on the same type of fabric as the cutting target material 43. When the user does not use the cutting device 4 and manually cuts the applique piece 7 using scissors and so on along the cutting index, the sewing machine 3 sews the contour of the partial pattern 60 serving as the cutting index on the same type of fabric as the cutting target material 43 according to the processing data.

The CPU 302 generates alignment data based on the partial pattern data stored in the partial pattern data storage portion 331 (S16). The alignment data is data for forming an alignment mark. The alignment mark is a mark sewn on the sewing target material 31 in order to indicate the position where the applique piece 7 is sewn on the sewing target material 31. The alignment mark is determined to have a slightly reduced shape so as to be arranged at a position approximately 0.5 mm inward from the contour of the applique piece 7. The alignment data includes needle drop coordinate data. The needle drop coordinate data of the alignment data is generated based on the needle drop coordinate data to which the contour attribute extracted from the needle drop coordinate data of the partial pattern data is added. For example, the CPU 302 generates an alignment mark image based on the extracted needle drop coordinate data. The CPU 302 applies contraction processing, which is a well-known image processing technique, to the generated alignment mark image. The CPU 302 calculates the needle drop coordinate data of the alignment data based on the image-processed alignment mark image. The CPU 302 stores the generated alignment data in the alignment data storage portion 334 of the RAM 303.

The CPU 302 generates sewing data based on the partial pattern data stored in the partial pattern data storage portion 331 (S18). The sewing data is data for the sewing machine 3 to execute satin stitch and so on for sewing the applique piece 7 to the sewing target material 31 along the contour of the applique piece 7. The sewing data includes needle drop coordinate data, stitch width data, density data, and offset data to which contour attributes are added. The needle drop coordinate data of the sewing data is generated by extracting the needle drop coordinate data to which the contour attribute is given from the needle drop coordinate data of the partial pattern data. The stitch width data is data representing the distance (or width) of stitches formed in a direction crossing the contour of the applique piece 7 in sewing such as satin stitch for sewing the applique piece 7. The density data is data representing the spacing (or density) of stitches formed in the direction along the contour of the applique piece 7 in sewing such as satin stitch for sewing the applique piece 7. The offset data is data representing the offset distance 70. The CPU 302 stores the generated sewing data in the sewing data storage portion 333 of the RAM 303.

The CPU 302 executes an overlap determination process (S20). The details of the overlap determination process will be described later.

Figures 10, 11:
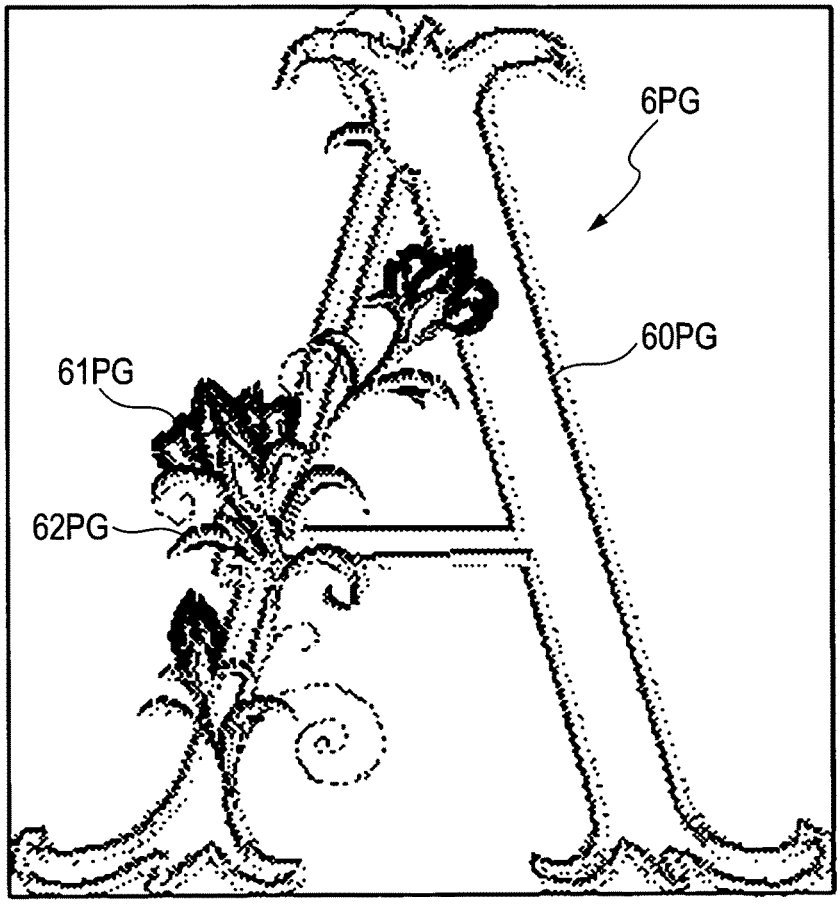
FIG. 10 is an explanatory diagram showing embroidery pattern data.
FIG. 11 is an explanatory diagram showing a preview image 6PG.

The CPU 302 changes the embroidery pattern data based on the processing data, the alignment data, and the sewing data (S24). The CPU 302 adds the processing data, the alignment data, and the sewing data to the embroidery pattern data. FIG. 10 shows an example of embroidery pattern data. The CPU 302 changes the sewing order of the embroidery pattern data including the processing data, the alignment data, and the sewing data. Regarding the sewing order, for example, after the applique piece 7 is cut according to the processing data, the alignment mark is sewn on the sewing target material 31 according to the alignment data, and the applique piece 7 is sewn on the sewing target material 31 according to the sewing data. After that, each of the partial patterns 60 to 62 is sewn on the applique piece 7 and the sewing target material 31. Thus, as shown in FIG. 10, the sewing order is set as "1" for the processing data, "2" for the alignment data, "3" for the sewing data, "4" for the partial pattern 60, "5" for the partial pattern 61, and "6" for the partial pattern 62. The CPU 302 changes the prohibition flag of the embroidery pattern data including the processing data, the alignment data, and the sewing data. For example, when the applique piece 7 having the same shape as the partial pattern 60 is cut, the partial pattern 60 is not sewn and the applique piece 7 is sewn. Thus, as shown in FIG. 10, the prohibition flag of the partial pattern 60 is set to "1".

The CPU 302 determines whether communication between the sewing machine 3 and the server 2 is possible (S26). The CPU 302 may determine whether communication between the sewing machine 3 and the server 2 is possible, for example, by communication using ping, which is one of the methods for confirming the normal operation of the server. When communication between the sewing machine 3 and the server 2 is possible (S26: YES), the CPU 302 advances the process to S28. When communication between the sewing machine 3 and the server 2 is not possible (S26: NO), the CPU 302 advances the process to S30.

When communication between the sewing machine 3 and the server 2 is possible (S26: YES), the embroidery pattern data is transmitted to the cutting device 4 via the server 2. The applique piece 7 is created by being cut by the cutting device 4, and sewing based on the processing data of the embroidery pattern data is not executed. Thus, the CPU 302 sets the prohibition flag to "1" for the processing data of the embroidery pattern data (S28).

When communication between the sewing machine 3 and the server 2 is not possible (S26: NO), the CPU 302 is unable to transmit the embroidery pattern data to the server 2. Since the applique piece 7 is manually cut and created by the user using scissors and so on, sewing is executed based on the processing data of the embroidery pattern data. Thus, the CPU 302 sets the prohibition flag to "0" for the processing data of the embroidery pattern data (S30).

It is assumed that the partial pattern 60 is selected in the processes of S6 to S10, and the partial pattern data corresponding to the partial pattern 60 is generated. In that case, the applique piece 7 having the same shape as the partial pattern 60 is created, the partial pattern 60 is not sewn, and the applique piece 7 is sewn to the sewing target material 31. Thus, the CPU 302 sets the prohibition flag of the partial pattern 60 to "1" (S32).

The CPU 302 generates a preview image 6PG (S34). The preview image 6PG is an image showing a work actually created by sewing an applique and embroidery as shown in FIG. 11. For example, the preview image 6PG shown in FIG. 11 is a partial preview image 60PG representing an applique pattern in which the applique piece 7 having the same shape as the partial pattern 60 is sewn, a partial preview image 61PG representing a stitch pattern in which the partial pattern 61 is embroidered, and a partial preview image 62PG representing a stitch pattern in which the partial pattern 62 is embroidered.

The CPU 302 displays the preview image 6PG on the display 307 (S36). The user visually checks the finish of the work by looking at the preview image 6PG.

The CPU 302 determines whether communication between the sewing machine 3 and the server 2 is possible (S38). The CPU 302 may determine whether communication between the sewing machine 3 and the server 2 is possible, for example, by communication using ping. When communication between the sewing machine 3 and the server 2 is possible (S38: YES), the CPU 302 advances the process to S40. When communication between the sewing machine 3 and the server 2 is not possible (S38: NO), the CPU 302 advances the process to S42. When communication between the sewing machine 3 and the server 2 is not possible (S38: NO), the applique piece 7 is created by being cut by the user with scissors and so on.

When communication between the sewing machine 3 and the server 2 is possible (S38: YES), the CPU 302 transmits the embroidery pattern data to the server 2 (S40). The embroidery pattern data is transmitted from the sewing machine 3 to the server 2 via the access point 11 and the network 10. The embroidery pattern data transmitted to the server 2 is transmitted from the server 2 to the cutting device 4 via the network 10 and the access point 11. The CPU 402 of the cutting device 4 stores the received embroidery pattern data in the embroidery pattern data storage portion 431 of the RAM 403. The CPU 402 extracts processing data from the stored embroidery pattern data. The CPU 402 stores the extracted processing data as cutting data in the cutting data storage portion 430 of the RAM 403. The CPU 402 executes a cutting program stored in the cutting program storage portion 410 of the ROM 401. The CPU 402 controls the cutting device 4 based on the cutting data stored in the cutting data storage portion 430. By this control, the cutting target material 43 is cut and the applique piece 7 is created.

The CPU 302 executes the sewing process (S42). The details of the sewing process will be described later. When the sewing process is executed, the embroidery control process ends.

<Overlap Determination Process>

Figure 12A:
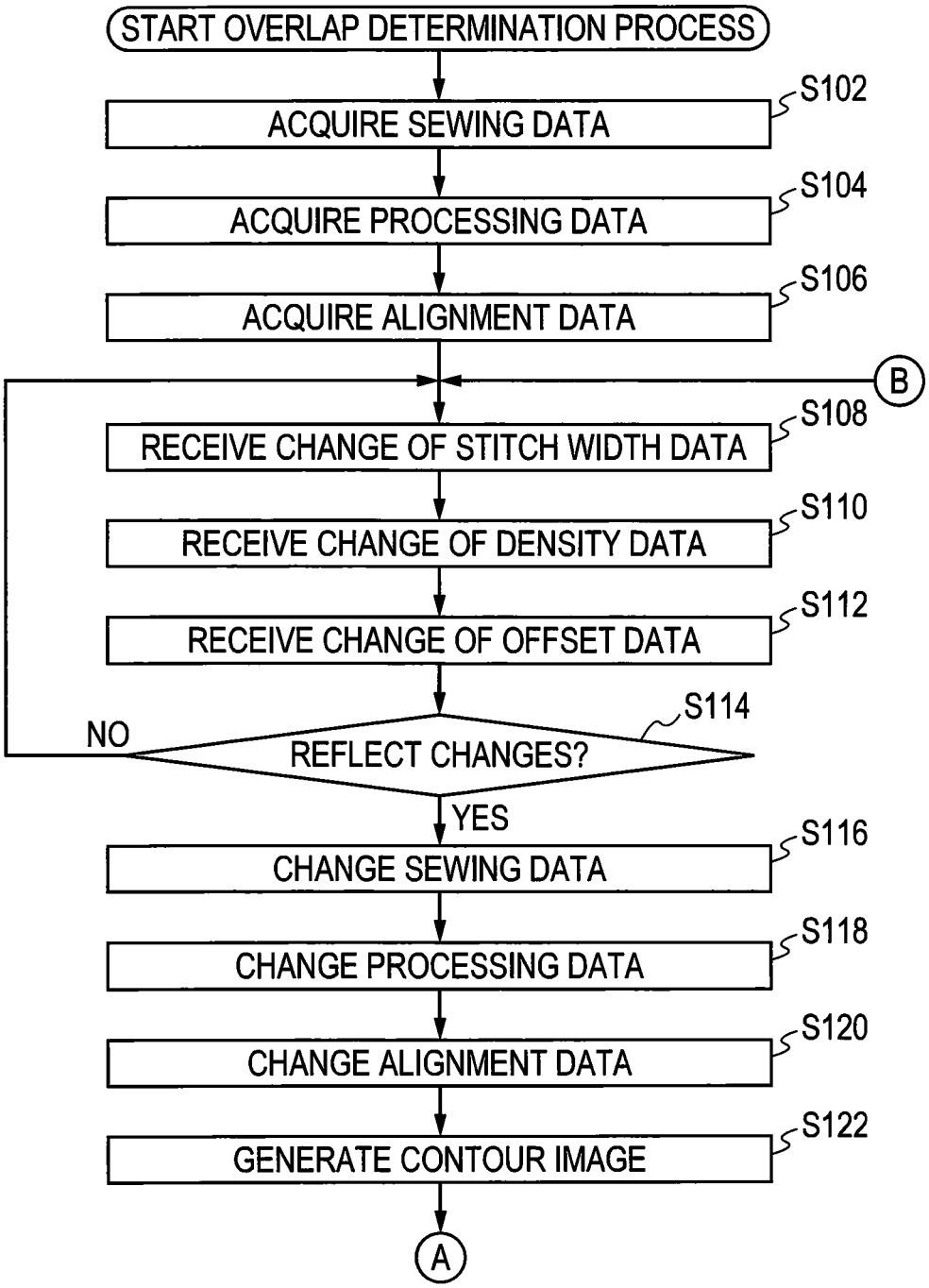
FIG. 12A is a part of a flowchart of an overlap determination process executed by the sewing machine 3.
Figure 12B:
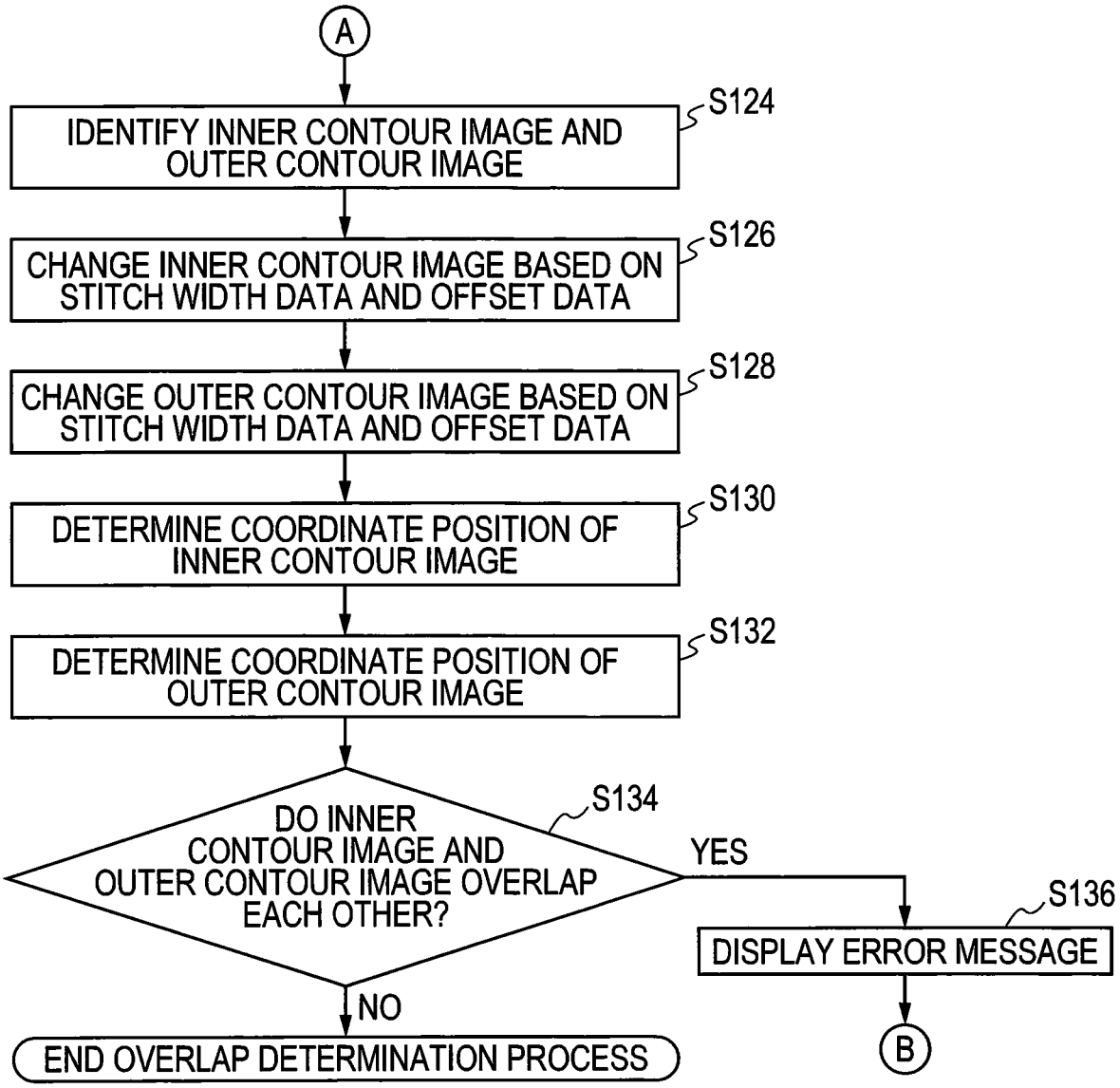
FIG. 12B is another part of the flowchart of the overlap determination process.

The operation of the overlap determination process executed by the sewing machine 3 will be described according to the flowchart shown in FIGS. 12A and 12B. Each of the series of processes shown in S102 to S136 in FIGS. 12A and 12B is a process executed by the CPU 302 of the sewing machine 3.

The CPU 302 reads and acquires the sewing data from the sewing data storage portion 333 of the RAM 303 (S102).

The CPU 302 reads and acquires the processing data from the processing data storage portion 332 of the RAM 303 (S104).

The CPU 302 reads and acquires the alignment data from the alignment data storage portion 334 of the RAM 303 (S106).

The change reception screen 8 shown in FIG. 3 is displayed on the display 307. The CPU 302 receives a change in the stitch width data of the sewing data (S108). The user operates the touch panel 306 and touches the stitch width operation button 82 while the CPU 302 is receiving the change of the stitch width data. When the stitch width operation button 82 is touched, the display screen displayed on the display 307 transitions to the stitch width change screen. On the stitch width change screen, the user freely changes the value of the stitch width data within the range of positive values of 2.0 mm or more. For example, the change in the value of the stitch width data is executed such that when the user touches the plus (+) button on the stitch width change screen, the stitch width increases by 0.5 mm, and when the user touches the minus (−) button, the stitch width decreases by 0.5 mm. After changing the value of the stitch width data, the user touches the OK button on the stitch width change screen. When the OK button is touched, the CPU 302 stores the changed stitch width data value in the temporary data storage portion 336 of the RAM 303. The display screen transitions from the stitch width change screen to the change reception screen 8.

The CPU 302 receives a change in the density data of the sewing data (S110). The user operates the touch panel 306 and touches the density operation button 83 while the CPU 302 is receiving the change of the density data. When the density operation button 83 is touched, the display screen displayed on the display 307 transitions to the density change screen. On the density change screen, the user freely changes the value of the density data within a range of positive values of 0.25 line/mm or more. For example, the change in the value of the density data is executed such that when the user touches the plus (+) button on the density change screen, the density increases by 0.25 line/mm, and when the user touches the minus (−) button, the density decreases by 0.25 line/mm. After changing the value of the density data, the user touches the OK button on the density change screen. When the OK button is touched, the CPU 302 stores the changed density data value in the temporary data storage portion 336 of the RAM 303. The display screen transitions from the density change screen to the change reception screen 8.

The CPU 302 receives a change in the offset data of the sewing data (S112). The user operates the touch panel 306 and touches the offset operation button 84 while the CPU 302 is receiving the change of the offset data. When the offset operation button 84 is touched, the display screen displayed on the display 307 transitions to the offset change screen 86 shown in FIG. 4. On the offset change screen 86, the user freely changes the offset distance 70 within a range of positive and negative values. For example, the change in the offset distance 70 is executed such that when the user touches the plus (+) button of the offset change portion 87, the offset distance 70 increases by 0.5 mm, and when the user touches the minus (−) button, the offset distance 70 decreases by 0.5 mm. After changing the offset distance 70, the user touches the OK button 88 on the offset change screen 86. When the OK button 88 is touched, the CPU 302 stores the changed offset distance 70 in the temporary data storage portion 336 of the RAM 303. The display screen transitions from the offset change screen 86 to the change reception screen 8.

The CPU 302 determines whether to reflect the changes in the stitch width data, the density data, and the offset data (S114). For example, when the user wants to reflect the value changed in the processes of S108 to S112, the user touches the Next button 85 of the change reception screen 8 displayed on the display 307. When the Next button 85 is touched by the user, the CPU 302 determines that the changes in the stitch width data, the density data, and the offset data are to be reflected (S114: YES). If the Next button 85 is not touched by the user, the CPU 302 determines that the changes in the stitch width data, the density data, and the offset data are not to be reflected (S114: NO), and executes the processes of S108 to S112 again.

When the CPU 302 determines in S114 that the change is to be reflected (S114: YES), the CPU 302 changes the sewing data (S116). The sewing data is changed based on the stitch width data value, the density data value, and the offset distance 70, which are stored in the temporary data storage portion 336 of the RAM 303. The changed sewing data is stored in the sewing data storage portion 333 of the RAM 303.

The CPU 302 changes the processing data (S118). The processing data is changed based on the offset distance 70 stored in the temporary data storage portion 336. The method of changing the processing data is not particularly limited, but for example, the CPU 302 generates a processing pattern image based on the needle drop coordinate data of the processing data. The CPU 302 applies expansion-contraction processing, which is a well-known image processing technique, to a processing pattern image based on the offset distance of 70. The CPU 302 calculates the needle drop coordinate data of the processing data from the processing pattern image reflecting the offset distance 70, and changes the processing data. The changed processing data is stored in the processing data storage portion 332 of the RAM 303.

The CPU 302 changes the alignment data (S120). The alignment data is changed based on the offset distance 70 stored in the temporary data storage portion 336. The method of changing the alignment data is not particularly limited, but is changed by a well-known image processing technique, for example, as in the case of changing the processing data of S118. The changed alignment data is stored in the alignment data storage portion 334 of the RAM 303.

The CPU 302 generates a contour image based on the needle drop coordinate data of the sewing data (S122). The contour image is an image representing the shape of the contour of the partial pattern 60. In the contour image, the contour line of the partial pattern 60 is represented in white, and the areas other than the contour line of the partial pattern 60 are represented in black.

Figure 13:
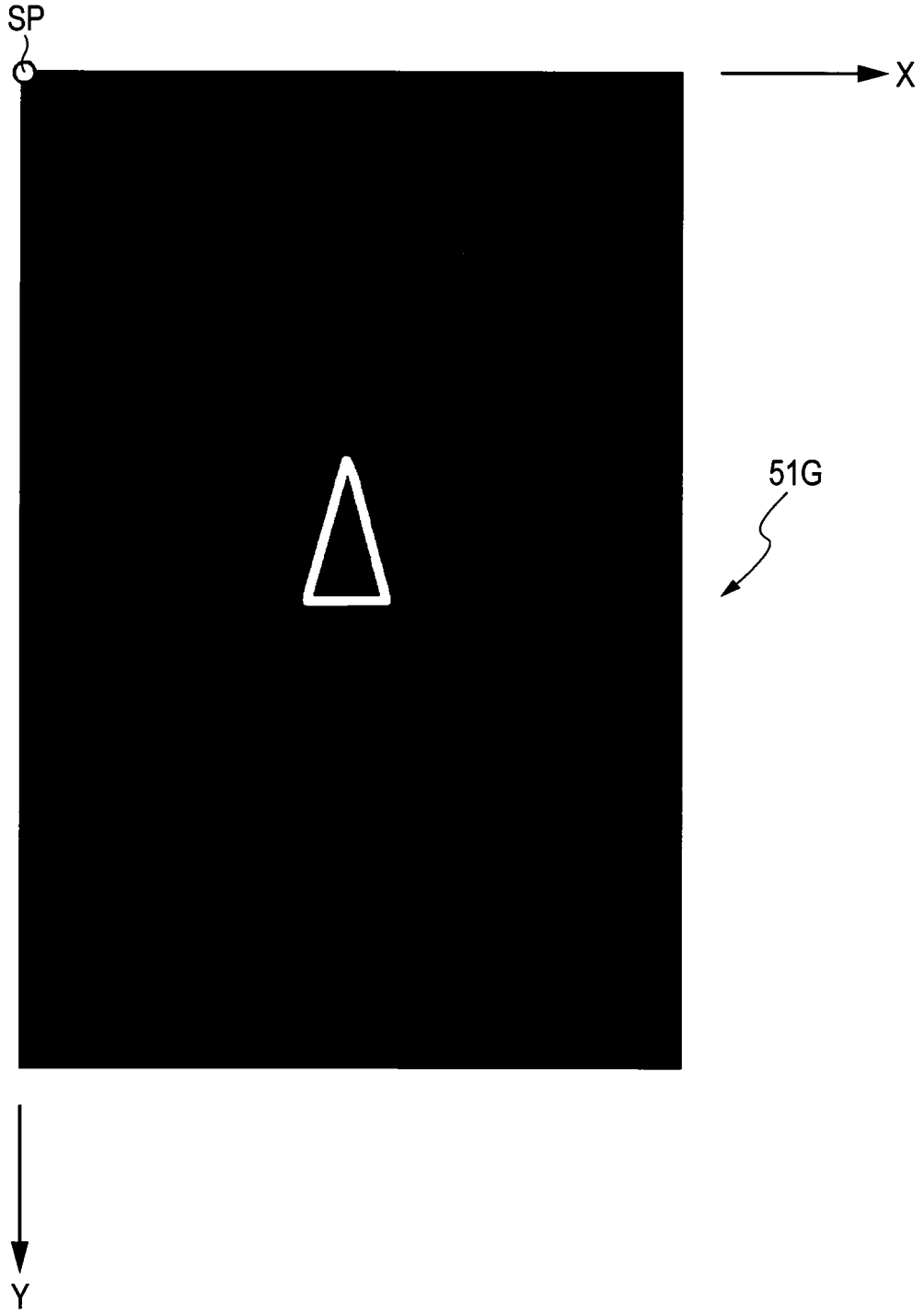
FIG. 13 is an explanatory diagram showing an inner contour image 51G.
Figure 14:
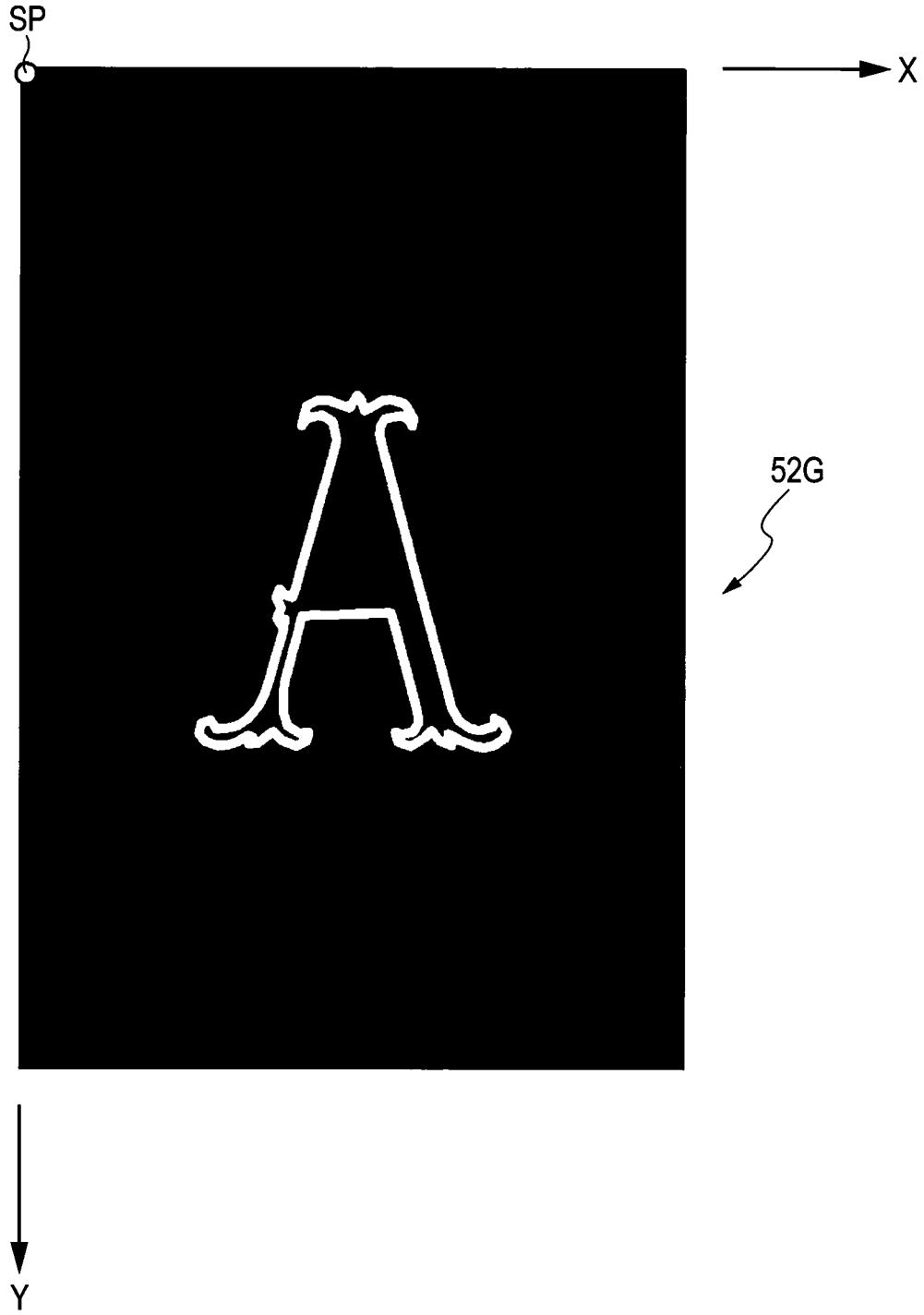
FIG. 14 is an explanatory diagram showing an outer contour image 52G.

The CPU 302 identifies an inner contour image 51G and an outer contour image 52G based on the contour image (S124). The inner contour image 51G is an image representing the shape of the inner contour of the partial pattern 60 as shown in FIG. 13. In the inner contour image 51G, the inner contour line of the partial pattern 60 is represented in white, and the areas other than the inner contour line of the partial pattern 60 are represented in black. The outer contour image 52G is an image representing the shape of the outer contour line of the partial pattern 60 as shown in FIG. 14. In the outer contour image 52G, the outer contour line of the partial pattern 60 is represented in white, and the areas other than the outer contour line of the partial pattern 60 are represented in black. The inner contour image 51G and the outer contour image 52G are identified by applying contour identifying processing, which is a well-known image processing technique, to the contour image. The CPU 302 stores the inner contour image 51G and the outer contour image 52G in the image data storage portion 335 of the RAM 303.

The CPU 302 changes the inner contour image 51G stored in the image data storage portion 335 based on the stitch width data and the offset data (S126). The CPU 302 expands or contracts the inner contour line of the inner contour image 51G based on the value of the stitch width data and the offset distance 70 by the expansion-contraction processing which is a well-known image processing technique. The inner contour image 51G is changed to the inner contour image 51G that reflects the value of the stitch width data and the offset distance 70. The changed inner contour image 51G is stored in the image data storage portion 335 of the RAM 303.

The CPU 302 changes the outer contour image 52G stored in the image data storage portion 335 based on the stitch width data and the offset data (S128). The CPU 302 expands or contracts the outer contour line of the outer contour image 52G based on the value of the stitch width data and the offset distance 70 by the expansion-contraction processing which is a well-known image processing technique. The outer contour image 52G is changed to the outer contour image 52G that reflects the value of the stitch width data and the offset distance 70. The changed outer contour image 52G is stored in the image data storage portion 335 of the RAM 303.

The CPU 302 determines the coordinate position of the inner contour image 51G stored in the image data storage portion 335 (S130). In the present embodiment, the inner contour image 51G is an image drawn in the XY coordinate system, and has a drawing range defined by a particular length in the X-axis direction and the Y-axis direction orthogonal to each other, for example, a range depicted in black in FIG. 13. In this drawing range, the position of the upper-left corner is defined as a coordinate origin SP.

The CPU 302 determines the coordinate position of the outer contour image 52G stored in the image data storage portion 335 (S132). In the present embodiment, the outer contour image 52G is an image drawn in the XY coordinate system, and has a drawing range having the same size as the inner contour image 51G in the X-axis direction and the Y-axis direction orthogonal to each other, for example, a range depicted in black in FIG. 14. In this drawing range, the position of the upper-left corner is defined as the coordinate origin SP as in the inner contour image 51G.

The CPU 302 determines whether the stitch of the inner contour and the stitch of the outer contour are closer to each other than a particular distance or overlap each other in the partial pattern 60 (S134). In the present embodiment, the threshold value representing the particular distance is set to "0", so that the CPU 302 determines whether the stitch of the inner contour and the stitch of the outer contour overlap each other. The CPU 302 compares the pixel values at the same coordinate position of the inner contour image 51G and the outer contour image 52G sequentially from the coordinate origin SP to the coordinate position at the lower-right corner of the drawing range based on the coordinate positions determined in S130 and S132. In the inner contour image 51G and the outer contour image 52G, when the pixel values at the same coordinate position match and have a value representing white, the coordinate position where the contour line of the inner contour image 51G and the contour line of the outer contour image 52G overlap exists. In the present embodiment, the value representing white is the pixel value "255" in a gray scale image. Thus, when the pixel values at the same coordinate positions of the inner contour image 51G and the outer contour image 52G match and have the value representing white, the CPU 302 determines that the inner contour stitch and the outer contour stitch in the partial pattern 60 overlap each other (S134: YES). When the pixel values at the same coordinate position of the inner contour image 51G and the outer contour image 52G do not match or do not have the value representing white, and the comparison is completed up to the last coordinate position of the inner contour image 51G and the outer contour image 52G, the CPU 302 determines that the stitch of the inner contour and the stitch of the outer contour do not overlap in the partial pattern 60 (S134: NO). In the present embodiment, the last coordinate position is the coordinate position at the lower-right corner of the drawing range of the inner contour image 51G and the outer contour image 52G. When the CPU 302 determines for the partial pattern 60 that the stitch of the inner contour and the stitch of the outer contour are closer to each other than a particular distance or overlap each other (S134: YES), the CPU 302 advances the process to S136. The CPU 302 ends the overlap determination process when the CPU 302 determines for the partial pattern 60 that the stitch of the inner contour and the stitch of the outer contour are not closer to each other than the particular distance or do not overlap (S134: NO).

Figure 15:
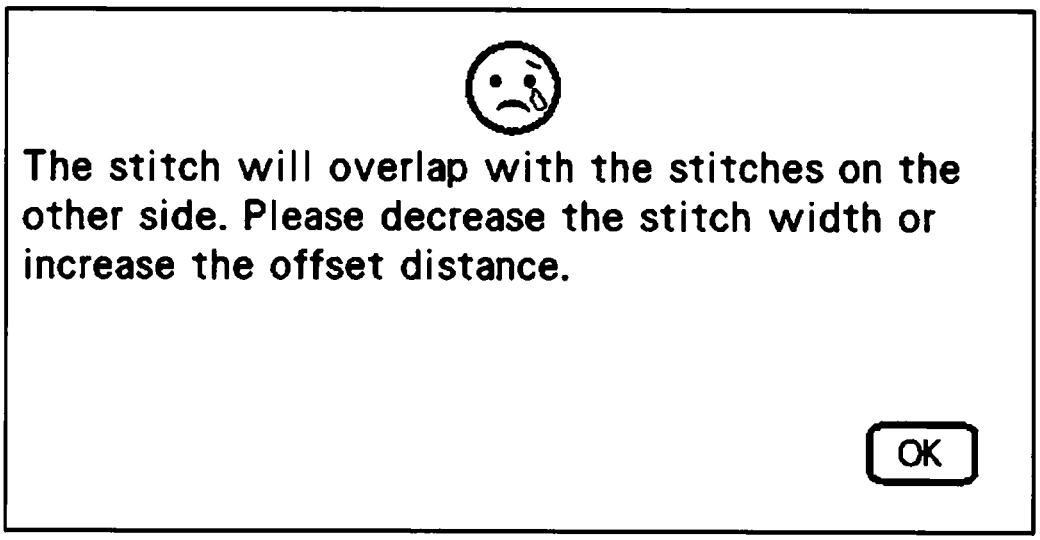
FIG. 15 is an explanatory diagram showing an error message.

The CPU 302 displays an error message on the display 307 (S136). The error message is the message shown in FIG. 15. The error message prompts the user to reduce the stitch width or increase the offset distance since the stitch of the inner contour overlaps the stitch of the outer contour. The CPU 302 returns the process to S108 and executes the processes of S108 to S134 again. When the process of S134 is executed again, the comparison between the inner contour image 51G and the outer contour image 52G is executed again sequentially from the coordinate origin SP.

<Sewing Process>

Figure 16:
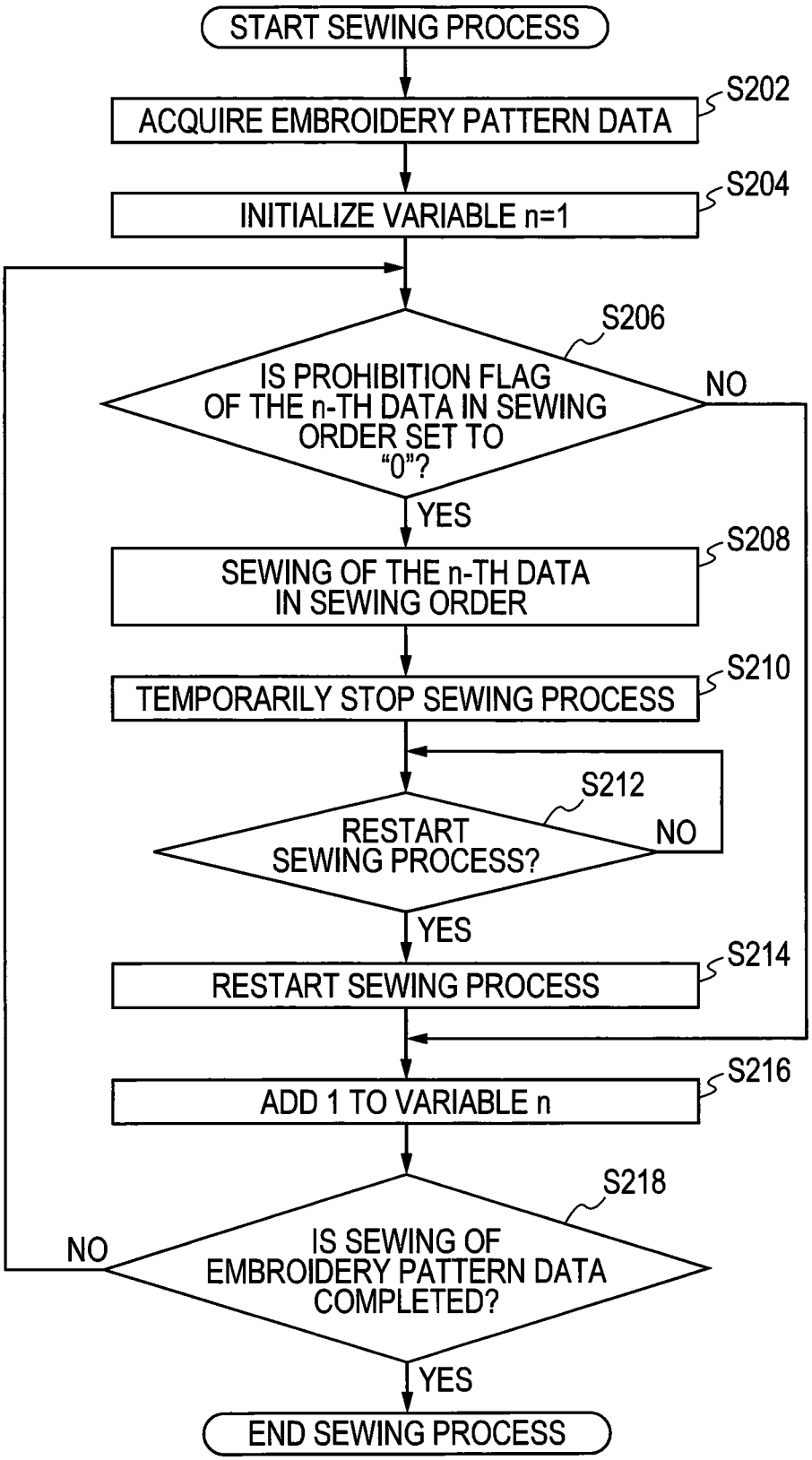
FIG. 16 is a flowchart of a sewing process executed by the sewing machine 3.

The operation of the sewing process executed by the sewing machine 3 will be described according to the flowchart shown in FIG. 16. Each of the series of processes shown in S202 to S218 in FIG. 16 is a process executed by the CPU 302 of the sewing machine 3.

The CPU 302 reads and acquires the embroidery pattern data from the embroidery pattern data storage portion 330 of the RAM 303 (S202).

The CPU 302 initializes a variable n to "1" (S204). The variable n is a value indicating the sewing order of the data currently being processed in the process of S206 to S218 described later. For example, when n is "2", it means that the data whose sewing order is "2" is processed in S206 to S218. Initially, since the processing starts from the data whose sewing order is "1", n is initialized to "1".

The CPU 302 determines whether the prohibition flag of the n-th data in the sewing order is "0" (S206). When the prohibition flag of the n-th data in the sewing order is "0" (S206: YES), sewing is executed based on the n-th data in the sewing order, so that the CPU 302 advances the process to S208. When the prohibition flag of the n-th data in the sewing order is "1" (S206: NO), sewing based on the n-th data in the sewing order is not executed, so the CPU 302 advances the process to S216.

The CPU 302 controls the sewing machine motor and so on so that sewing is executed based on the n-th data in the sewing order (S208). The n-th data in the sewing order is any one of processing data, alignment data, sewing data, and partial pattern data corresponding to each of the partial patterns 60 to 62. All of these data include the needle drop coordinate data. The CPU 302 controls the stitch pattern to be sewn on the sewing target material 31 based on the needle drop coordinate data.

After the stitch pattern is sewn in S208, the CPU 302 temporarily stops the sewing process such as control of the sewing machine motor (S210). During the stop, the user performs operations such as thread change, cutting of the applique piece 7, and placing the applique piece 7 on the sewing target material 31, that is, making preparations necessary for sewing according to the data of the next sewing order.

The CPU 302 determines whether to restart the sewing process (S212). During the stop of S210, the user touches the OK button displayed on the touch panel 306 when the preparation is completed. When the CPU 302 recognizes that the OK button has been touched by the user, the CPU 302 determines that the sewing process is restarted (S212: YES). If the OK button is not touched by the user, the CPU 302 determines that the sewing process is not restarted yet (S212: NO), and repeats the process of S212.

When the CPU 302 determines that the sewing process is restarted (S212: YES), the CPU 302 restarts the sewing process (S214).

The CPU 302 adds "1" to the variable n (S216). By adding "1" to the variable n, the CPU 302 moves to the processing of the data in the next sewing order.

The CPU 302 determines whether sewing is completed for all of data included in the embroidery pattern data (S218). The CPU 302 determines whether the n-th data in the sewing order exists in the embroidery pattern data. When the n-th data in the sewing order exists, the CPU 302 determines that the sewing is not completed because the data to be sewn still remains in the embroidery pattern data (S218: NO). If the n-th data in the sewing order does not exist, the CPU 302 determines that all of data included in the embroidery pattern data is processed, and sewing is completed (S218: YES). When the CPU 302 determines that sewing is not completed (S218: NO), the CPU 302 returns the process to S206 and executes a series of processes of S206 to S218 again. When the CPU 302 determines that sewing is completed (S218: YES), the CPU 302 ends the sewing process.

According to the system 1, before sewing an applique piece having a hole on a sewing target material, the user is notified that the stitch of the inner contour and the stitch of the outer contour are arranged at positions closer to each other than a particular distance or at positions overlapping each other. Thus, the user can easily modify the data or change the shape of the applique piece, which prevents deterioration of the appearance of the stitch of the sewing around the hole of the applique piece in advance.

According to the system 1, the user is free to change and set sewing data including the stitch width data and the offset data. Thus, the user can change the shape of the applique piece to a desired size and realize the sewing of the applique piece with a stitch width suitable for the shape of the applique piece.

According to the system 1, the user is free to set the value of the offset distance in the range of positive or negative values. For example, when the offset distance is set to a negative value, it is more likely that the stitch of the inner contour and the stitch of the outer contour are arranged at positions closer to each other than a particular distance or at positions overlapping each other. This further increases an advantage of notification of an error.

According to the system 1, image processing is used to determine whether the stitch of the inner contour and the stitch of the outer contour are arranged at positions closer to each other than the particular distance or at positions overlapping each other. By performing processing based on the image, more accurate determination is performed.

According to the system 1, by comparing the pixel values of the images with the same origin, it is determined whether the stitch of the inner contour and the stitch of the outer contour are arranged at positions closer to each other than the particular distance or at positions overlapping each other. By matching the origins of the inner contour image and the outer contour image, more accurate determination is performed.

According to the system 1, based on the image reflecting the stitch width data and the offset data, it is determined whether the stitch of the inner contour and the stitch of the outer contour are arranged at positions closer to each other than the particular distance or at positions overlapping each other. Thus, more accurate determination is performed in consideration of the stitch width data and the offset data.

In the present embodiment, the embroidery control process shown in FIG. 9, the overlap determination process shown in FIGS. 12A and 12B, and the sewing process shown in FIG. 16 are executed by the sewing machine 3. Thus, the sewing machine 3 does not need to communicate with an external device other than the server 2 that communicates with the cutting device 4, and smoothly executes the processes by reducing the influence of a communication waiting time, a communication failure, and so on.

In the present embodiment, after the error message is displayed on the display 307 of the sewing machine 3 by the processing of S136, the sewing data is changed on the sewing machine 3 by the processing of S108 to S116 while the execution of the overlap determination process is continued. Thus, the user can easily change the sewing data when there is an error in the sewing data.

In the present embodiment, it is determined in S26 whether the sewing machine 3 communicates with the server 2, and the processing data is used for one of the two uses according to the determination result. That is, the prepared two uses are a case where the processing data is used to cut and create the applique piece 7 by the cutting device 4 (S28) and a case where the processing data is used to sew, on a cloth, a cutting index for manually cutting the applique piece 7 by the user (S30). Thus, even when communication with the server 2 is impossible, the processing data is effectively used for creating the applique piece 7.

The sewing machine 3 is an example of the applique data management apparatus and the sewing machine. The applique piece 7 shown in FIG. 8 is an example of the applique piece. The shape 5 having a hole shown in FIG. 2 is an example of a shape having a hole. The process of S102 in the overlap determination process shown in FIGS. 12A and 12B is an example of the sewing data acquisition portion. The inner contour 51 and the outer contour 52 shown in FIG. 2 are examples of the inner contour and the outer contour. The process of S124 in the overlap determination process shown in FIGS. 12A and 12B is an example of the contour identifying portion. The series of processes S130 to S134 in the overlap determination process shown in FIGS. 12A and 12B is an example of the determination portion. S136 in the overlap determination process shown in FIGS. 12A and 12B is an example of the error notification portion. The embroidery pattern 6 shown in FIG. 6 and the partial pattern 60 shown in FIG. 7 are examples of the embroidery pattern. The offset distance 70 shown in FIG. 8 is an example of the offset distance. The touch panel 306 is an example of the operation interface. The processes of S108 and S112 in the overlap determination process shown in FIGS. 12A and 12B is an example of the setting portion. The process of S116 in the overlap determination process shown in FIGS. 12A and 12B is an example of the data changing portion. The touch panel 306 is an example of the offset operation portion. The process of S122 in the overlap determination process shown in FIGS. 12A and 12B is an example of the contour image acquisition portion. The inner contour image 51G shown in FIG. 13 is an example of the inner contour image. The outer contour image 52G shown in FIG. 14 is an example of the outer contour image. The process of S124 in the overlap determination process shown in FIGS. 12A and 12B is an example of the contour image identifying means. The processes of S130 and S132 in the overlap determination process shown in FIGS. 12A and 12B are examples of the inner contour coordinate determining means and the outer contour coordinate determining means. The processes of S126 and S128 in the overlap determination process shown in FIGS. 12A and 12B is an example of the image changing portion. The program of the overlap determination process shown in FIGS. 12A and 12B is an example of the applique data management program.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described invention are provided below:

(1) In the present embodiment, the sewing machine 3 is configured as an applique data management apparatus, but the configuration is not limited to this. For example, the applique data management apparatus may be a desktop PC, a notebook PC, a tablet terminal, and a smartphone, and any apparatus may be used as long as it has the functions of at least acquiring sewing data, determining whether the stitch of the inner contour of the applique piece 7 and the stitch of the inner contour of the applique piece 7 are arranged at positions closer than a particular distance or at overlapping positions based on the sewing data, and outputting an error notification. Further, the applique data management apparatus may be configured to include an information processing apparatus such as a server that acquires sewing data and determines whether the stitch of the inner contour of the applique piece 7 and the stitch of the outer contour of the applique piece 7 are arranged at positions closer than a particular distance or at overlapping positions based on the sewing data and a display terminal that communicates with the information processing apparatus and output an error notification and that is carried by the user of the sewing machine.

(2) In the present embodiment, when the applique piece 7 is cut, the prohibition flag of the partial pattern 60 is set to "1" so that the partial pattern 60 is not sewn, but the configuration is not limited to this. For example, even when the applique piece 7 is cut and created, the prohibition flag of the partial pattern 60 may be left as "0" and the partial pattern 60 may be sewn on the applique piece 7.

(3) In the present embodiment, the CPU 302 determines by comparing the pixel values at the same coordinate positions of the inner contour image 51G and the outer contour image 52G, but the configuration is not limited to this. For example, a vector representing the coordinate position of the stitch of the inner contour may be compared with a vector representing the coordinate position of the stitch of the outer contour, and if they are the same vector, it may be determined that the stitch of the inner contour and the stitch of the outer contour are arranged at overlapping positions. In this modification, it is not necessary to generate the inner contour image 51G and the outer contour image 52G.

(4) In the present embodiment, the inner contour image 51G and the outer contour image 52G are identified by a well-known image processing technique, but the configuration is not limited to this. For example, the inner contour attribute and the outer contour attribute may be added in advance to the needle drop coordinate data of the partial pattern 60, and the inner contour image 51G and the outer contour image 52G may be generated from the needle drop coordinate data.

(5) In the present embodiment, when the pixel values at the same coordinate positions of the inner contour image 51G and the outer contour image 52G match and have the value representing white, it is determined that the stitch of the inner contour and the stitch of the outer contour of the partial pattern 60 overlap each other, but the configuration is not limited to this. For example, in the inner contour image 51G and the outer contour image 52G, even if the pixel values at the same coordinate positions match and have the value representing white, the comparison may be executed up to the last coordinate position, and then, it may be determined that the stitch of the inner contour and the stitch of the inner contour overlap each other. In this modification, an error occurrence location and an error in the sewing data may be notified for all of the plurality of stitches determined to be at the overlapping positions.

Figure 17:
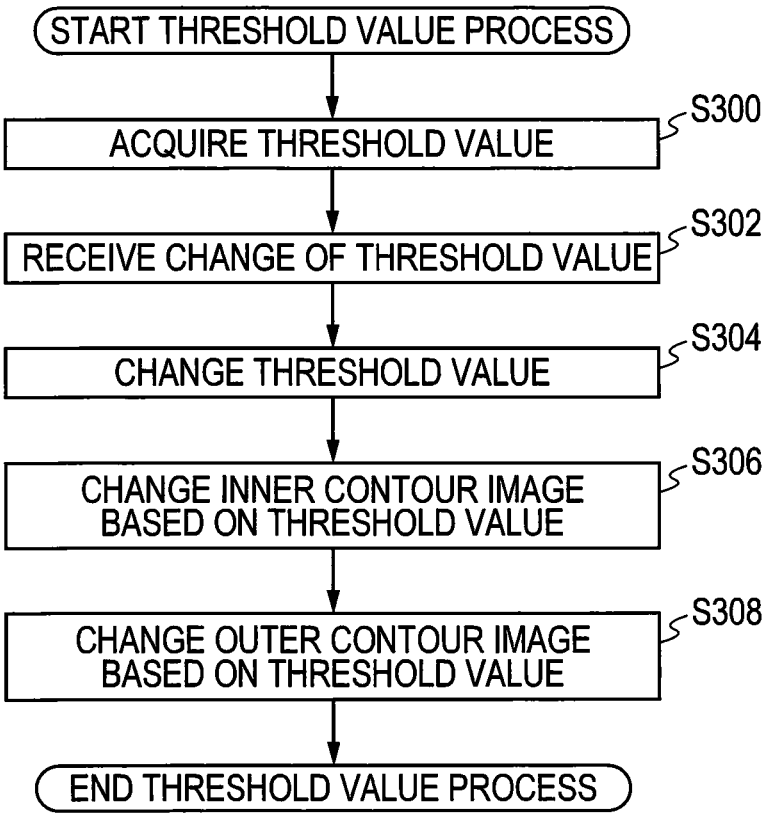
FIG. 17 is a flowchart of a threshold value process executed by the sewing machine 3.

(6) In the present embodiment, the threshold value representing the particular distance is set to "0", and it is determined whether the stitch of the inner contour and the stitch of the outer contour overlap each other, but the configuration is not limited to this. For example, the threshold value representing a particular distance may be configured to be freely changeable by the user. In this modification, the user determines the threshold value based on, for example, the thickness of the thread for sewing, the fabric thickness of the sewing target material, the density of the sewn stitches, and so on. In that case, the threshold value process shown in FIG. 17 is inserted between S128 and S130 of the overlap determination process shown in FIGS. 12A and 12B. The threshold value process will be described with reference to FIG. 17. In a modification, the flash ROM 304 shown in FIG. 5 includes a threshold value storage portion 341 for storing a threshold value changed by the user.

When the threshold value process is started, the CPU 302 acquires the threshold value stored in the threshold value storage portion 341 of the flash ROM 304 (S300).

The CPU 302 receives a change in the threshold value acquired in S300 (S302). The user operates the touch panel 306 to change the threshold value. For example, the threshold value is changed such that when a plus (+) button on a threshold value change screen displayed on the display 307 is touched, the threshold value is increased by 0.1 mm, and when a minus (−) button is touched, the threshold value is decreased by 0.1 mm. After changing the threshold value, the user touches an OK button on the threshold value change screen. When the OK button is touched, the CPU 302 stores the changed threshold value in the threshold value storage portion 341.

The CPU 302 changes the inner contour image 51G stored in the image data storage portion 335 based on the threshold value stored in the threshold value storage portion 341 (S306). The CPU 302 expands or contracts the inner contour line of the inner contour image 51G based on the threshold value by expansion-contraction processing, which is a well-known image processing technique. The inner contour image 51G is changed to the inner contour image 51G that reflects the threshold value. The changed inner contour image 51G is stored in the image data storage portion 335.

The CPU 302 changes the outer contour image 52G stored in the image data storage portion 335 based on the threshold value stored in the threshold value storage portion 341 (S308). The CPU 302 expands or contracts the outer contour line of the outer contour image 52G based on the threshold value by expansion-contraction processing, which is a well-known image processing technique. The outer contour image 52G is changed to the outer contour image 52G that reflects the threshold value. The changed outer contour image 52G is stored in the image data storage portion 335, and the threshold value process ends. For example, the CPU 302 expands (increases the width of) each of the inner contour line of the inner contour image 51G and the outer contour line of the outer contour image 52G by half (½) the particular distance. Then, the CPU 302 determines whether the expanded inner contour line and the expanded outer contour line overlap each other and, if the expanded inner contour line and the expanded outer contour line overlap each other, determines that the inner stitch and the outer stitch are located at positions closer to each other than the particular distance.

(7) In the present embodiment, the coordinate origin SP of the inner contour image 51G and the outer contour image 52G is determined as the coordinate position of the upper-left corner, but the configuration is not limited to this. For example, the coordinate origin SP of the inner contour image 51G and the outer contour image 52G may be the coordinate position at the upper-right corner or the central coordinate position.

(8) In the present embodiment, the error notification is outputted as a fixed error message shown in FIGS. 12A and 12B, but the configuration is not limited to this. For example, it may be notified, together with an error message, how much the stitch width and the offset distance 70 should be changed to eliminate the error. Only the change amount of the stitch width may be notified together with the error message, or only the change amount of the offset distance 70 may be notified together with the error message. Also, the error message may change depending on the error situation. For example, the error message may indicate the overlapping distance between the stitch of the inner contour and the stitch of the outer contour.

(9) In the present embodiment, the error notification is executed by displaying the error message shown in FIGS. 12A and 12B, but the configuration is not limited to this. For example, an error notification may be outputted by a sound such as an alert. Further, the sewing machine 3 and a printer may be connected, and the error information may be printed by the printer. Also, an image showing information about the error may be displayed. For example, the image showing the information about the error is an image in which a mark such as "x" (cross mark) is shown at the coordinate position where the error occurs in the inner contour image and the outer contour image.

What is claimed is:

1. An applique data management apparatus comprising:

an output interface; and a controller configured to:

acquire sewing data for sewing an applique piece on a sewing target material, the applique piece having a shape having a hole, the hole being a closed area surrounded by at least part of the applique piece;

identify a contour of the applique piece while distinguishing an inner contour and an outer contour, the inner contour being the contour defining the hole of the applique piece, the outer contour being the contour other than the inner contour;

determine, based on the acquired sewing data, whether an inner stitch and an outer stitch are arranged at positions closer to each other than a particular distance or at positions overlapping each other, the inner stitch being formed along the inner contour, the outer stitch being formed along the outer contour; and output an error notification through the output interface in response to determining that the inner stitch and the outer stitch are arranged at positions closer to each other than the particular distance or at positions overlapping each other.

2. The applique data management apparatus according to claim 1, further comprising:

an operation interface configured to be operated by a user; and a memory configured to store embroidery pattern data indicating an embroidery pattern having a particular size and shape, wherein the sewing data includes at least:

stitch width data indicating a stitch width of a stitch formed along the contour of the applique piece, the stitch width being a width in a direction crossing the contour; or offset data indicating an offset distance between a contour defining the shape of the embroidery pattern and the contour defining the shape of the applique piece, the shape of the applique piece being determined based on the shape of the embroidery pattern; and wherein the controller is configured to:

receive, via the operation interface, an operation for changing a value of at least the stitch width data or the offset data; and change the sewing data based on the value of at least the stitch width data or the offset data based on the received operation.

3. The applique data management apparatus according to claim 2, wherein the offset distance is changeable to a positive value and a negative value via the operation interface.

4. The applique data management apparatus according to claim 1, wherein the controller is configured to:

acquire a contour image indicating the contour of the applique piece, the contour image being generated based on the sewing data;

based on the acquired contour image, identifying an inner contour image indicating the inner contour and an outer contour image indicating the outer contour; and based on the identified inner contour image and outer contour image, determine whether the inner stitch and the outer stitch are arranged at positions closer to each other than the particular distance or at positions overlapping each other.

5. The applique data management apparatus according to claim 4, wherein the controller is configured to:

determine a coordinate position of each pixel indicating the inner contour image with reference to a particular origin;

determine a coordinate position of each pixel indicating the outer contour image with reference to the particular origin;

compare a pixel value of each pixel indicating the inner contour image and a pixel value of each pixel indicating the outer contour image at a same coordinate position; and based on comparison, determine whether the inner stitch and the outer stitch are arranged at positions closer to each other than the particular distance or at positions overlapping each other.

6. The applique data management apparatus according to claim 5, wherein the controller is configured to:

in response to determining that the pixel value of at least one pixel indicating the inner contour image and the pixel value of at least one pixel indicating the outer contour image at the same coordinate position match and have a value representing the contour, determine that the inner stitch and the outer stitch are arranged at positions overlapping each other; and in response to determining that, for all pixels in the contour image, the pixel value of each pixel indicating the inner contour image and the pixel value of each pixel indicating the outer contour image at the same coordinate position do not match or do not have the value representing the contour, determine that the inner stitch and the outer stitch are not arranged at positions overlapping each other.

7. The applique data management apparatus according to claim 5, further comprising:

an operation interface; and a memory configured to store a threshold value indicating the particular distance, wherein the controller is configured to:

acquires the threshold value stored in the memory;

receive a change of the threshold value via the operation interface and update the threshold value in the memory;

expand or contract an inner contour line in the inner contour image based on the threshold value by expansion-contraction processing;

expand or contract an outer contour line in the outer contour image based on the threshold value by the expansion-contraction processing;

in response to determining that the pixel value of at least one pixel indicating the inner contour image and the pixel value of at least one pixel indicating the outer contour image at the same coordinate position match and have a value representing the contour, determine that the inner stitch and the outer stitch are arranged at positions closer to each other than the particular distance; and in response to determining that, for all pixels in the contour image, the pixel value of each pixel indicating the inner contour image and the pixel value of each pixel indicating the outer contour image at the same coordinate position do not match or do not have the value representing the contour, determine that the inner stitch and the outer stitch are not arranged at positions closer to each other than the particular distance.

8. The applique data management apparatus according to claim 4, further comprising:

an operation interface configured to be operated by a user; and a memory configured to store embroidery pattern data indicating an embroidery pattern having a particular size and shape, wherein the sewing data includes at least:

stitch width data indicating a stitch width of a stitch formed along the contour of the applique piece, the stitch width being a width in a direction crossing the contour; or offset data indicating an offset distance between a contour defining the shape of the embroidery pattern and the contour defining the shape of the applique piece, the shape of the applique piece being determined based on the shape of the embroidery pattern; and wherein the controller is configured to:

receive, via the operation interface, an operation for changing a value of at least the stitch width data or the offset data;

change the sewing data based on the value of at least the stitch width data or the offset data based on the received operation;

change the inner contour image and the outer contour image based on at least the stitch width data or the offset data; and based on the changed inner contour image and outer contour image, determine whether the inner stitch and the outer stitch are arranged at positions closer to each other than the particular distance or at positions overlapping each other.

9. The applique data management apparatus according to claim 1, further comprising a communication interface configured to communicate with a server via a network, wherein the controller is configured to:

generates processing data indicating the contour of the applique piece;

determine whether communication with the server is possible;

in response to determining that the communication with the server is possible, transmit the processing data to the server via the communication interface, the transmitted processing data being used as cutting data for cutting the applique piece with a cutting device; and in response to determining that the communication with the server is not possible, use the processing data as data for sewing a cutting index indicating the contour of the applique piece, the cutting index being used for manually cutting the applique piece.

10. A sewing machine comprising:

an output interface; and a controller configured to:

acquire sewing data for sewing an applique piece on a sewing target material, the applique piece having a shape having a hole, the hole being a closed area surrounded by at least part of the applique piece;

identify a contour of the applique piece while distinguishing an inner contour and an outer contour, the inner contour being the contour defining the hole of the applique piece, the outer contour being the contour other than the inner contour;

determine, based on the acquired sewing data, whether an inner stitch and an outer stitch are arranged at positions closer to each other than a particular distance or at positions overlapping each other, the inner stitch being formed along the inner contour, the outer stitch being formed along the outer contour; and output an error notification through the output interface in response to determining that the inner stitch and the outer stitch are arranged at positions closer to each other than the particular distance or at positions overlapping each other.

11. A non-transitory computer-readable storage medium storing an applique data management program including a set of program instructions for an applique data management apparatus, the set of program instructions, when executed by a controller of the applique data management apparatus, causing the applique data management apparatus to perform:

acquiring sewing data for sewing an applique piece on a sewing target material, the applique piece having a shape having a hole, the hole being a closed area surrounded by at least part of the applique piece;

identifying a contour of the applique piece while distinguishing an inner contour and an outer contour, the inner contour being the contour defining the hole of the applique piece, the outer contour being the contour other than the inner contour;

determining, based on the acquired sewing data, whether an inner stitch and an outer stitch are arranged at positions closer to each other than a particular distance or at positions overlapping each other, the inner stitch being formed along the inner contour, the outer stitch being formed along the outer contour; and outputting an error notification through an output interface of the applique data management apparatus in response to determining that the inner stitch and the outer stitch are arranged at positions closer to each other than the particular distance or at positions overlapping each other.

* * * * *